US010656588B2

(12) United States Patent
Asakawa

(10) Patent No.: US 10,656,588 B2
(45) Date of Patent: May 19, 2020

(54) IMAGE FORMING APPARATUS AND CONTROL PROGRAM

(71) Applicant: Konica Minolta, Inc., Chiyoda-ku, Tokyo (JP)

(72) Inventor: Minoru Asakawa, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/433,197

(22) Filed: Feb. 15, 2017

(65) Prior Publication Data

US 2017/0242389 A1 Aug. 24, 2017

(30) Foreign Application Priority Data

Feb. 22, 2016 (JP) ..... 2016-031296

(51) Int. Cl.
*G03G 15/00* (2006.01)

(52) U.S. Cl.
CPC ..... *G03G 15/70* (2013.01); *G03G 2215/0043* (2013.01); *G03G 2215/00434* (2013.01);
(Continued)

(58) Field of Classification Search
CPC ..... G03G 15/70; G03G 2215/0043; G03G 2215/00434; G03G 2215/00438;
(Continued)

(56) References Cited

U.S. PATENT DOCUMENTS 5,182,597 A * 1/1993 Masuda ..... G03G 15/30 340/675
9,802,778 B2 * 10/2017 Isobe ..... B65H 7/18
(Continued)

FOREIGN PATENT DOCUMENTS

JP 62085261 4/1987
JP 05039147 2/1993
(Continued)

OTHER PUBLICATIONS

Notice of Reasons for Refusal issued in corresponding Japanese Patent Application No. 2016-031296, dated Dec. 17, 2019, with English Translation (10 pages).
(Continued)

*Primary Examiner* — David H Banh
(74) *Attorney, Agent, or Firm* — Buchanan Ingersoll & Rooney PC

(57) ABSTRACT

An image forming apparatus includes: a sheet conveyance unit which includes a sheet conveyance path and conveys a sheet; a sheet detector which detects the sheet in the sheet conveyance path; a job acquiring unit which acquires a print job related to the sheet; an image forming unit which forms an image on the sheet; and a processor which controls the sheet conveyance unit to perform one of first sheet conveyance and second sheet conveyance, the first sheet conveyance being performed to convey the sheet in accordance with sheet information, the second sheet conveyance being performed to convey the sheet and discharge the sheet to outside in accordance with a result of detection, wherein when sheet conveyance is resumed after suspension, the processor controls the sheet conveyance unit to perform the second sheet conveyance on a remaining sheet.

15 Claims, 13 Drawing Sheets

(52) U.S. Cl.
CPC ..... *G03G 2215/00438* (2013.01); *G03G 2215/00548* (2013.01); *G03G 2215/00552* (2013.01); *G03G 2215/0135* (2013.01)

(58) Field of Classification Search
CPC ..... G03G 2215/00548; G03G 2215/00552; G03G 2215/0135; H04N 1/3877; B65H 7/06
See application file for complete search history.

(56) References Cited

U.S. PATENT DOCUMENTS

2006/0177236 A1* 8/2006 Kowari ..... G03G 15/5004 399/88
2007/0109586 A1* 5/2007 Yamada ..... G06F 3/121 358/1.14
2009/0073247 A1* 3/2009 Kaneko ..... B41J 11/006 347/104
2009/0310982 A1* 12/2009 Mano ..... G03G 15/6541 399/18
2009/0310983 A1* 12/2009 Shoji ..... G03G 15/6529 399/20
2012/0051823 A1* 3/2012 Hoshino ..... B41J 11/70 400/582
2014/0079411 A1* 3/2014 Saitsu ..... G03G 15/70 399/21
2015/0049356 A1* 2/2015 Saitsu ..... B65H 7/06 358/1.14
2015/0098715 A1* 4/2015 Sakurai ..... G03G 15/55 399/18
2015/0316887 A1* 11/2015 Zhu ..... G03G 15/70 399/21
2015/0338808 A1* 11/2015 Ishihara ..... B65H 7/02 399/401
2016/0096391 A1* 4/2016 Shimura ..... G03G 15/6544 270/1.01
2016/0154364 A1* 6/2016 Kamata ..... G03G 15/70 399/21

FOREIGN PATENT DOCUMENTS

JP 08091692 4/1996
JP 2005-84234 A 3/2005
JP 2006091330 4/2006
JP 2007017508 1/2007

OTHER PUBLICATIONS

Notice of Reasons for Refusal issued in corresponding Japanese Patent Application No. 2016-031296, dated Oct. 8, 2019, with English Translation (12 pages).

* cited by examiner

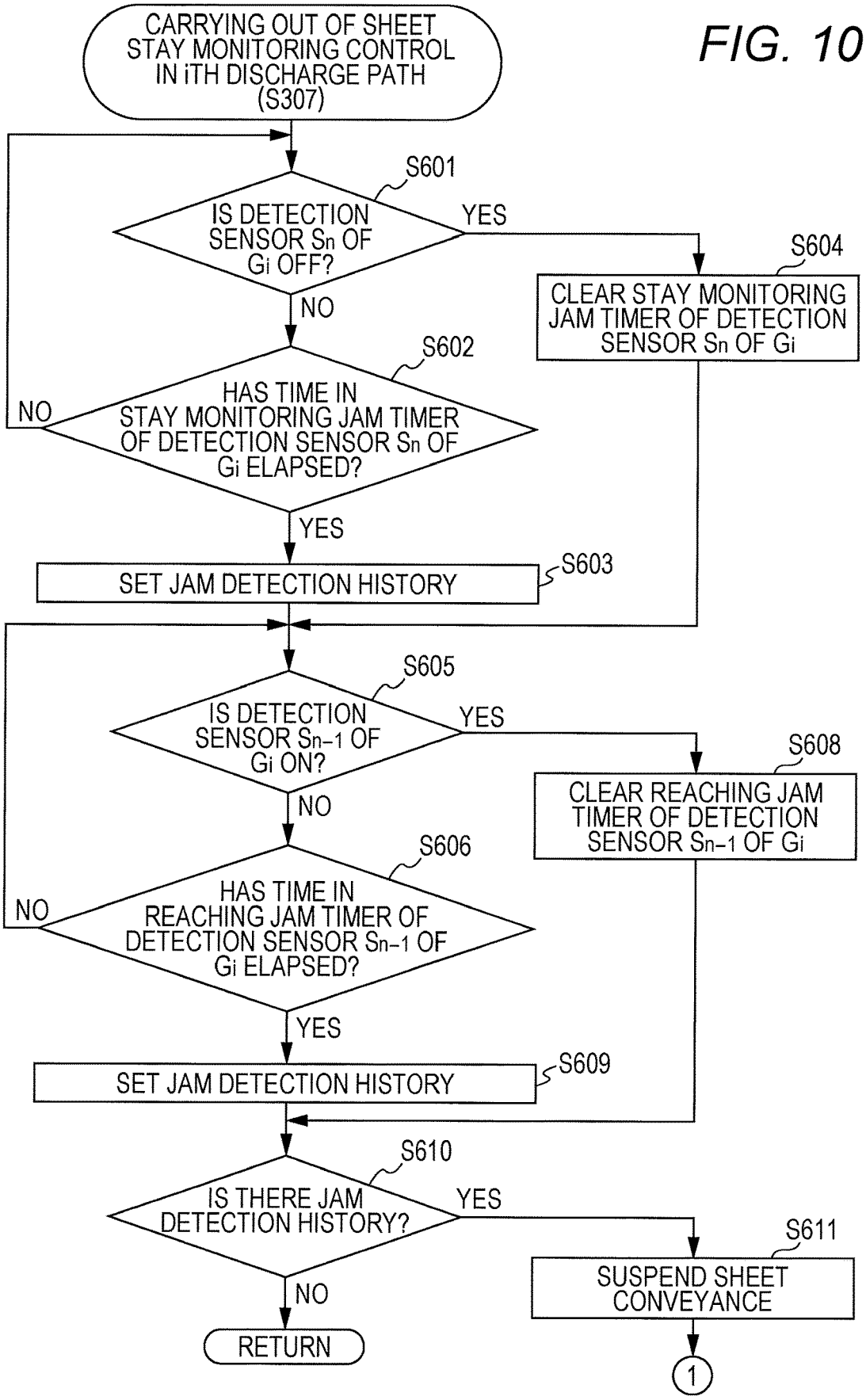
FIG. 10
CARRYING OUT OF SHEET STAY MONITORING CONTROL IN iTH DISCHARGE PATH (S307)
S601
IS DETECTION SENSOR Sn OF Gi OFF?
YES
NO
S604
CLEAR STAY MONITORING JAM TIMER OF DETECTION SENSOR Sn OF Gi
S602
HAS TIME IN STAY MONITORING JAM TIMER OF DETECTION SENSOR Sn OF Gi ELAPSED?
NO
YES
SET JAM DETECTION HISTORY
S603
S605
IS DETECTION SENSOR Sn-1 OF Gi ON?
YES
NO
S608
CLEAR REACHING JAM TIMER OF DETECTION SENSOR Sn-1 OF Gi
S606
HAS TIME IN REACHING JAM TIMER OF DETECTION SENSOR Sn-1 OF Gi ELAPSED?
NO
YES
SET JAM DETECTION HISTORY
S609
S610
IS THERE JAM DETECTION HISTORY?
YES
NO
S611
SUSPEND SHEET CONVEYANCE
RETURN
1

IMAGE FORMING APPARATUS AND CONTROL PROGRAM

The entire disclosure of Japanese Patent Application No. 2016-031296 filed on Feb. 22, 2016 including description, claims, drawings, and abstract are incorporated herein by reference in its entirety.

BACKGROUND OF THE INVENTION

Field of the Invention

The present invention relates to an image forming apparatus and a control program.

Description of the Related Art

There is a demand for a decrease in the burden imposed on a user when a paper jam occurs in an image forming apparatus. When a paper jam is detected in a sheet conveyance path in which paper sheets are conveyed, an image forming apparatus normally suspends the printing process being currently carried out, and starts a jam clearing process to return to the normal sheet conveyance that was being performed before the paper jam occurred. At that time, the sheet conveyance in the sheet conveyance path is also suspended. As a result, some paper sheets might remain in the sheet conveyance path. A paper sheet remaining in the sheet conveyance path will be hereinafter also referred to as a "remaining paper sheet".

In a jam clearing process, an image forming apparatus normally prompts the user to remove the remaining paper sheets that might hinder the later sheet conveyance from the sheet conveyance path. The remaining paper sheets to be removed includes the paper sheet that has caused the paper jam (this paper sheet will be hereinafter referred to as the "jam causing sheet"), for example. This is because it is often difficult to mechanically remove the remaining paper sheet that might hinder sheet conveyance, and the user needs to remove such a remaining paper sheet. To reduce the load on users in this regard, some of the recently developed image forming apparatuses have a function to display information, such as the position of a jam causing sheet and a sheet removing method, on a touch panel display or the like.

To reduce the load on users, some image forming apparatuses further have a function to automatically discharge remaining paper sheets in the sheet conveyance path, without any help from user-s. After the above mentioned remaining paper sheets that might hinder the sheet conveyance are removed by a user, paper sheets that do not hinder the sheet conveyance might remain in the sheet conveyance path. In a case where such paper sheets that do not hinder sheet conveyance remain in the sheet conveyance path, the image forming apparatus mechanically and automatically conveys the paper sheets, and discharges the paper sheets to the outside of the image forming apparatus (this discharge of remaining paper sheets will be hereinafter referred to as "automatic discharge").

Paper sheets in an image forming apparatus are normally managed and conveyed in accordance with a print job the image forming apparatus receives from a client terminal or the like. When sheet conveyance in the sheet conveyance path is suspended due to a jam clearing process or the like, the image forming apparatus saves the states of the respective remaining paper sheets. When the sheet conveyance is resumed later, and the remaining paper sheets are automatically discharged, the image forming apparatus performs sheet conveyance in accordance with the print job and the saved states of the remaining paper sheets (see JP 2005-84234 A, for example).

However, to remove a remaining paper sheet such as a jam causing sheet that hinders automatic discharge, a user opens a door on the front side of the image forming apparatus, and pulls out the rack in which the sheet conveyance path is accommodated. In doing so, the user might notice a remaining paper sheet that can be automatically discharged, and inadvertently remove the remaining paper sheet. Furthermore, when operating a cancellation lever, the user might greatly move the remaining paper sheet that can be automatically discharged, and cause overlapping between the remaining paper sheets. As a result, when automatic discharge is started, the saved states of the remaining paper sheet grasped by the image forming apparatus might differ from, the states of the actual remaining paper sheets in the sheet conveyance path. In this case, the image forming apparatus faces an unexpected situation where remaining paper sheets that should be there have disappeared, remaining paper sheets overlap each other, remaining paper sheets have changed positions, or the like. As a result, conveyance of the remaining paper sheets might fail.

As described above, if the states of remaining paper sheets that can be automatically discharged have changed after suspension of sheet conveyance in the sheet conveyance path, the image forming apparatus might fail to automatically discharge the remaining paper sheets properly.

SUMMARY OF THE INVENTION

The present invention has been made in view of the above problems. Therefore, an object of the present invention is to provide an image forming apparatus that can automatically discharge remaining sheets without fail, even if the states of the remaining sheets that can be automatically discharged have changed after suspension of sheet conveyance in a sheet conveyance path.

The above object of the present invention is achieved with structures described below.

(1) To achieve the abovementioned object, according to an aspect, an image forming apparatus reflecting one aspect of the present invention comprises: a sheet conveyance unit configured to include a sheet conveyance path and convey a sheet along the sheet conveyance path; a sheet detector configured to detect the sheet in the sheet conveyance path; a job acquiring unit configured to acquire a print job related to the sheet; an image forming unit configured to form an image on the sheet; and a processor configured to control the sheet conveyance unit to perform one of first sheet conveyance and second sheet conveyance, the first sheet conveyance being performed to convey the sheet in accordance with sheet information included in the print job, the second sheet conveyance being performed to convey the sheet and discharge the sheet to outside in accordance with a result of detection performed by the sheet detector, regardless of the sheet information, wherein when sheet conveyance in the sheet conveyance path is resumed after suspension, the processor controls the sheet conveyance unit to perform the second sheet conveyance on a remaining sheet which remains in the sheet conveyance path and does not hinder the sheet conveyance resumed after suspension.

(2) The image forming apparatus of Item. 1, wherein when the sheet conveyance in the sheet conveyance path is resumed after the first sheet conveyance is suspended due to a paper jam in the sheet conveyance path, the processor preferably controls the sheet conveyance unit to perform the second sheet conveyance on a remaining sheet which remains in the sheet conveyance path and does not hinder the sheet conveyance, after a remaining sheet hindering the sheet conveyance is removed by a user.

(3) The image forming apparatus of Item. 1, wherein when a power supply to the image forming apparatus is switched on to activate the image forming apparatus and resume the sheet conveyance in the sheet conveyance path after the power supply to the image forming apparatus is switched off to stop the image forming apparatus while the first sheet conveyance is being performed or the first sheet conveyance is suspended to stop the sheet conveyance due to a paper jam in the sheet conveyance path, the processor preferably controls the sheet conveyance unit to perform the second sheet conveyance on a remaining sheet not hindering the sheet conveyance, after a remaining sheet hindering the sheet conveyance is removed by a user.

(4) The image forming apparatus of any one of Items. 1 to 3, wherein while the second sheet conveyance is being performed, the processor preferably determines whether a remaining sheet is being properly conveyed, in accordance with a staying time during which the remaining sheet stays at a first position in the sheet conveyance path, and a reaching time required for the remaining sheet to be conveyed from the first position to a second position located on a downstream side of the first position in a sheet conveying direction, the staying time and the reaching time being determined with respect to each remaining sheet being conveyed in the sheet conveyance path.

(5) The image forming apparatus of Item. 4, wherein the sheet detector preferably includes a plurality of detection sensors including first and second detection sensors disposed at the first and second positions, respectively, and the processor preferably acquires the staying time by measuring a time during which the remaining sheet being conveyed in the sheet conveyance path stays within a detection range of the first detection sensor, and acquires the reaching time by measuring a time required for the remaining sheet to be detected by the second detection sensor after detected by the first detection sensor.

(6) The image forming apparatus of Item. 5, wherein the processor preferably determines whether the remaining sheet is being properly conveyed, in accordance with a speed of conveyance of the remaining sheet being conveyed in the sheet conveyance path, the length of the remaining sheet in a direction of conveyance of the remaining sheet, and the staying time and the reaching time.

(7) The image forming apparatus of any one of Items. 4 to 6, wherein when the staying time is not longer than a predetermined staying time, the processor preferably determines that the remaining sheet is being properly conveyed.

(8) The image forming apparatus of any one of Items. 4 to 7, wherein when the reaching time is not longer than a predetermined reaching time, the processor preferably determines that the remaining sheet is being properly conveyed.

(9) The image forming apparatus of Item. 8, wherein the predetermined staying time is preferably set in accordance with a time required for two remaining sheets to successively pass through the first position, the two remaining sheets having the greatest length in the sheet conveying direction among the remaining sheets.

(10) The image forming apparatus of Item. 8, wherein the predetermined staying time is preferably set in accordance with a time required for two sheets to successively pass through the first position, the two sheets having the greatest length in the sheet conveying direction among sheets conveyable in the sheet conveyance path.

(11) The image forming apparatus of any one of Items. 1 to 10, wherein when each of the remaining sheets is monitored for a conveyance error in the sheet conveyance path during the second sheet conveyance, and the conveyance error monitoring is completed on all the remaining sheets, the processor preferably determines that all the remaining sheets have been discharged.

(12) The image forming apparatus of anyone of Items. 1 to 11, wherein the processor preferably sets priorities for each of a plurality of conveyance sections defined in the sheet conveyance path during the second sheet conveyance, and, in accordance with the priority order, controls the sheet conveyance unit to discharge the remaining sheets to outside.

(13) The image forming apparatus of any one of Items. 1 to 12, wherein the processor preferably sets discharge paths for each of a plurality of conveyance sections defined in the sheet conveyance path during the second sheet conveyance, and controls the sheet conveyance unit to discharge the remaining sheets to outside through the discharge paths.

(14) To achieve the abovementioned object, according to an aspect, a non-transitory recording medium storing a computer readable control program reflecting one aspect of the present invention causes an image forming apparatus to execute: starting a printing process, and conveying a sheet along a sheet conveyance path in the image forming apparatus, in accordance with sheet information included in a print job; suspending the printing process and suspending sheet conveyance in the sheet conveyance path; and conveying a remaining sheet not in accordance with the sheet information but in accordance with a result of detection performed by a sheet detector installed in the sheet conveyance path, regardless of the sheet information, in the second sheet conveyance, and discharging the remaining sheet to outside, the remaining sheet not hindering the sheet conveyance.

(15) To achieve the abovementioned object, according to an aspect, an image forming method reflecting one aspect of the present invention comprises: conveying a sheet along a sheet conveyance path; detecting the sheet in the sheet conveyance path; acquiring a print job related to the sheet; forming an image on the sheet; performing first sheet conveyance wherein the sheet is conveyed in accordance with sheet information included in the print job, and, when sheet conveyance in the sheet conveyance path is resumed after suspension, performing second sheet conveyance on a remaining sheet which remains in the sheet conveyance path and does not hinder the sheet conveyance, the sheet being conveyed and discharged to outside in accordance with a result of the sheet detection, regardless of the sheet information, in the second sheet conveyance.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 10 is a subroutine flowchart showing an example of "carrying out of the sheet stay monitoring control in the ith discharge path (S307)" shown in FIG. 7;

DESCRIPTION OF THE PREFERRED EMBODIMENTS

Figure 1:
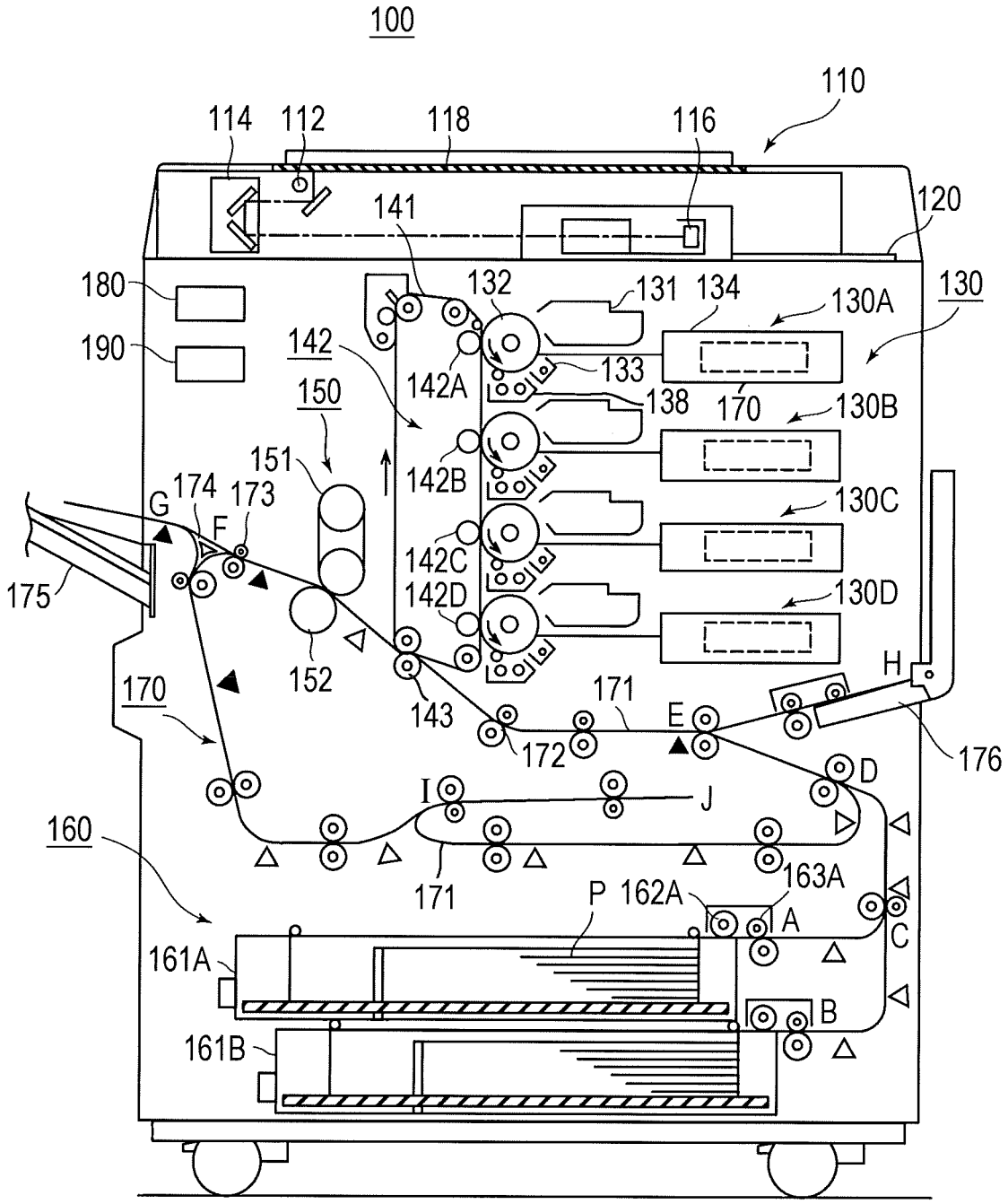
FIG. 1 is a schematic cross-sectional diagram showing an example structure of an image forming apparatus according to an embodiment of the present invention.

Hereinafter, an image forming apparatus and a control program according to an embodiment of the present invention will be described with reference to the drawings. However, the scope of the invention is not limited to the illustrated examples. In the drawings, like components are denoted by like reference numerals. The dimensional ratios in the drawings are increased for ease of explanation, and may differ from the actual dimensional ratios.

Embodiment

<Image Forming Apparatus 100>

Figure 2:
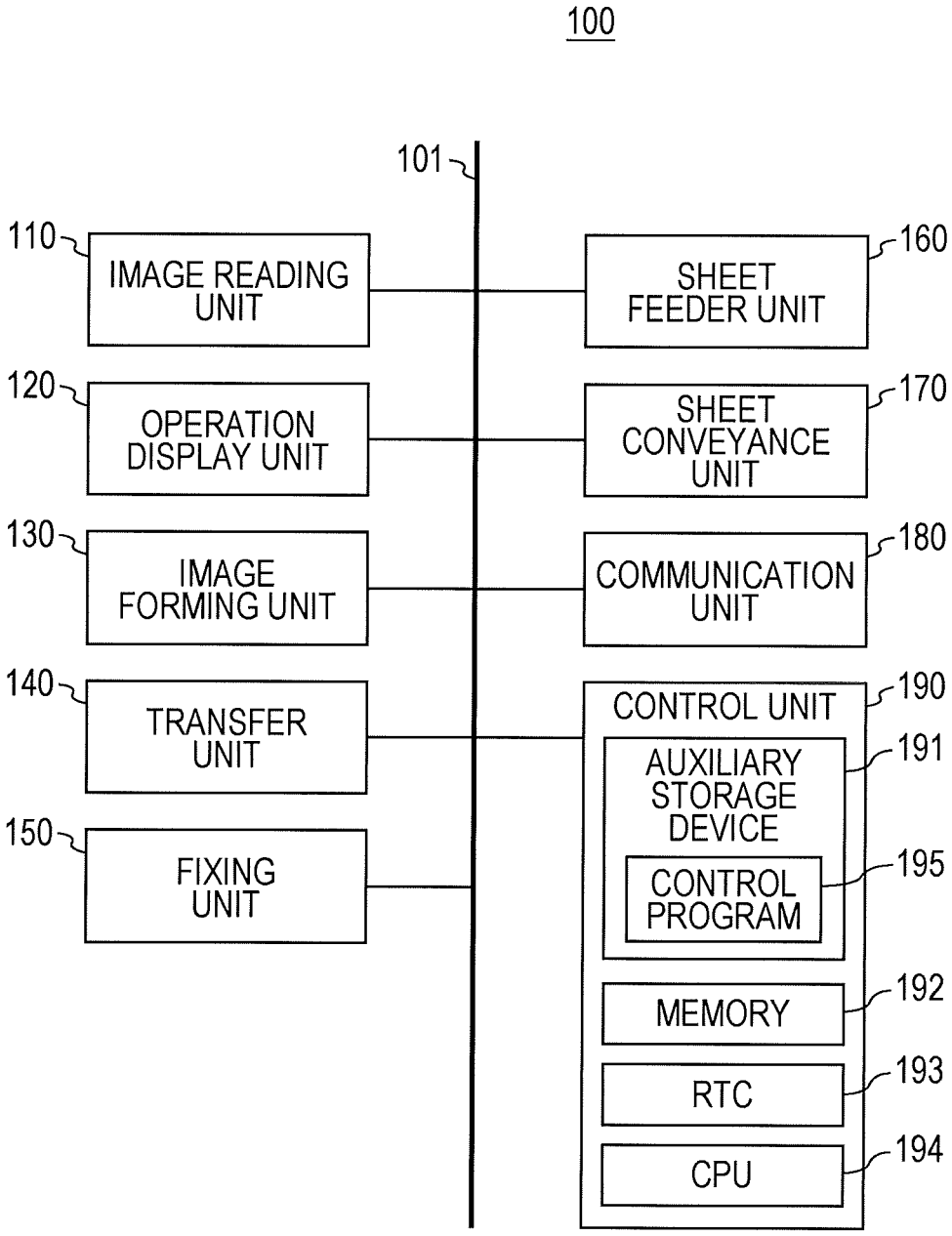
FIG. 2 is a schematic block diagram showing an example hardware configuration of the image forming apparatus shown in FIG. 1.
Figure 3A:
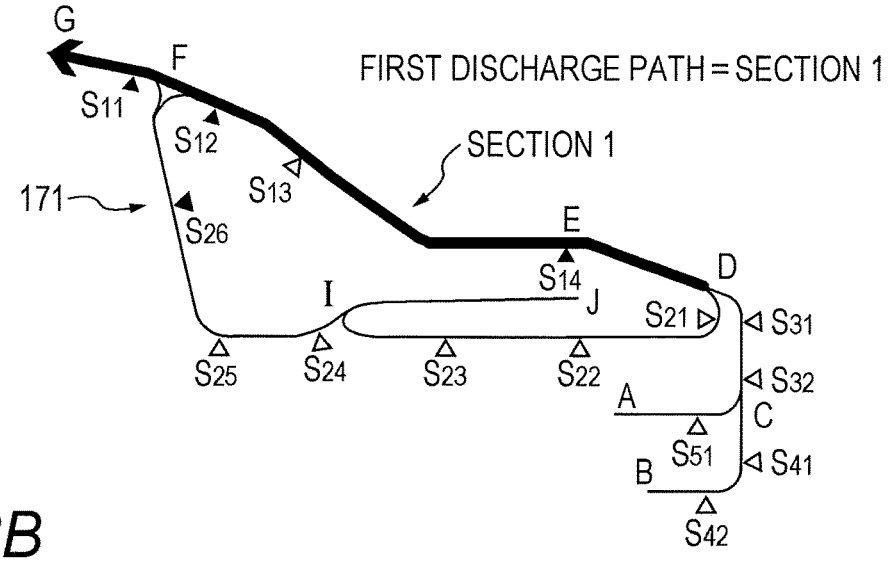
FIG. 3A is a schematic diagram showing an example of a first discharge path according to an embodiment of the present invention.
Figure 3B:
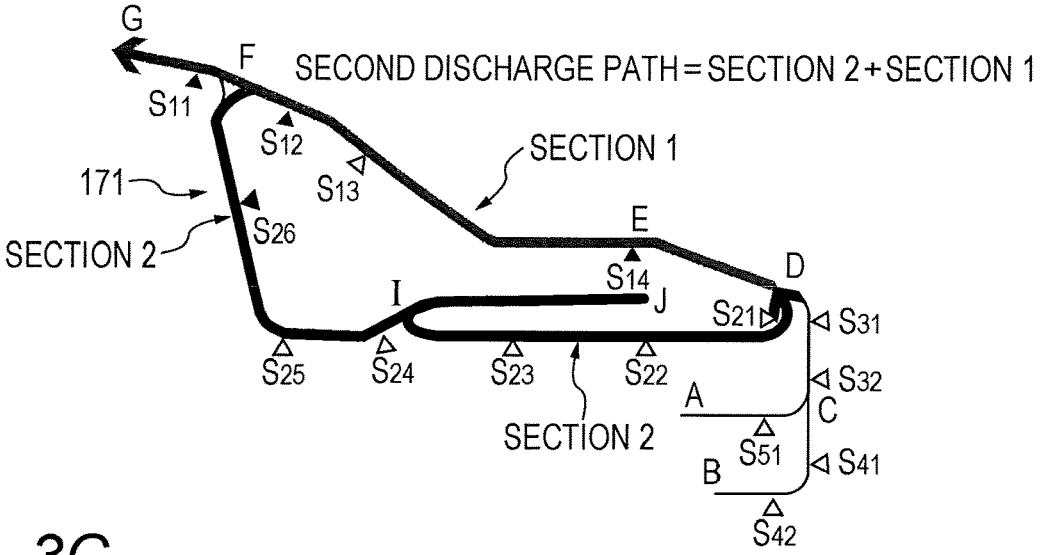
FIG. 3B is a schematic diagram showing an example of a second discharge path according to an embodiment of the present invention.
Figure 3C:
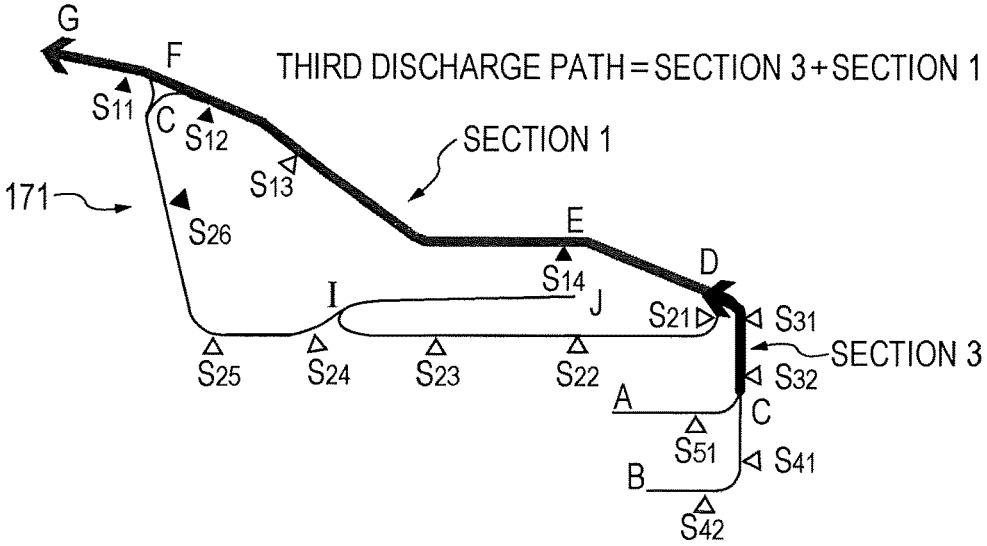
FIG. 3C is a schematic diagram showing an example of a third discharge path according to an embodiment of the present invention.
Figure 3D:
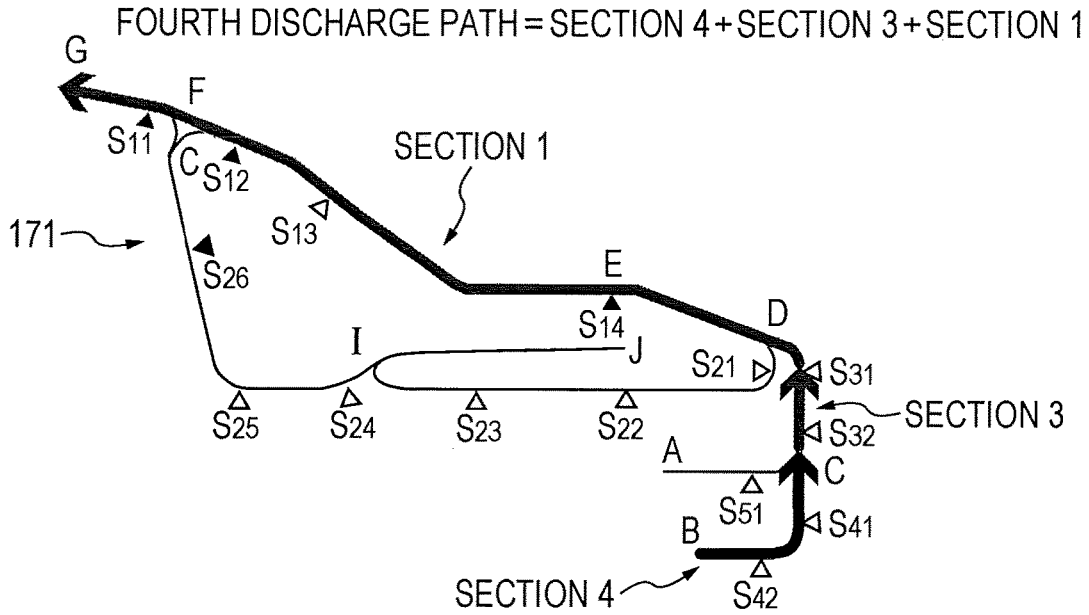
FIG. 3D is a schematic diagram showing an example of a fourth discharge path according to an embodiment of the present invention.
Figure 3E:
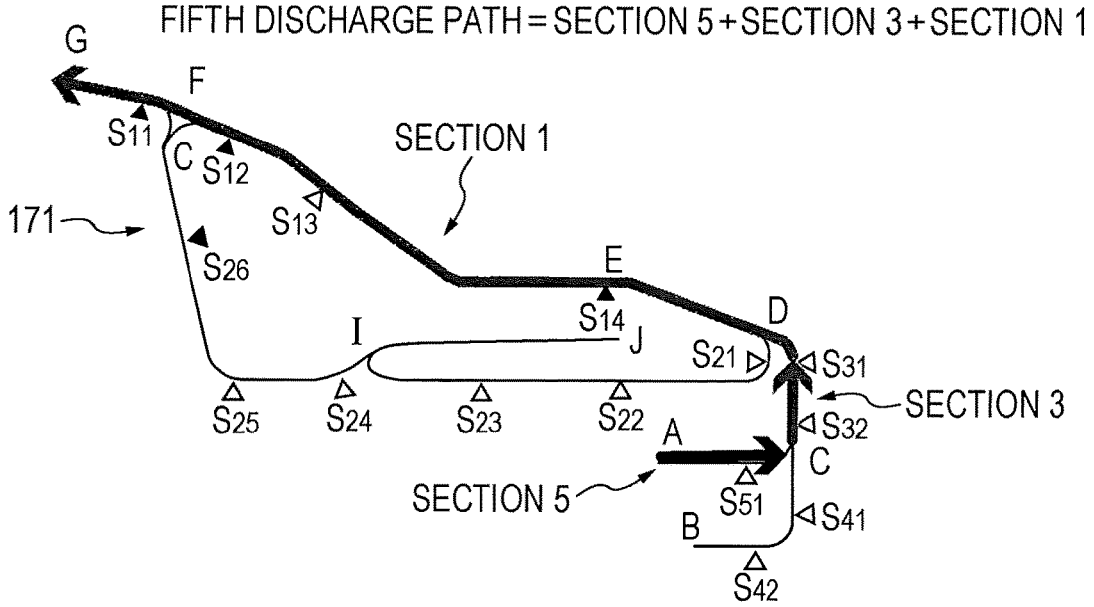
FIG. 3E is a schematic diagram showing an example of a fifth discharge path according to an embodiment of the present invention.

FIG. 1 is a schematic cross-sectional diagram showing an example structure of an image forming apparatus according to an embodiment of the present invention. FIG. 2 is a schematic block diagram showing an example hardware configuration of the image forming apparatus shown in FIG. 1.

As shown in FIGS. 1 and 2, the image forming apparatus 100 of this embodiment includes an image reading unit 110, an operation display unit 120, an image forming unit 130, a transfer unit 140, a fixing unit 150, a sheet feeder unit 160, a sheet conveyance unit 170, a communication unit 180, and a control unit 190. The description below will focus on the principal components of the image forming apparatus 100 of this embodiment.

<Image Reading Unit 110>

The image reading unit 110 is used to generate image data of an original document, and includes a light source 112, an optical system 114, and an imaging device 116. The light source 112 emits light onto the document placed on a reading surface 118, and the light reflected by the document forms an image in the imaging device 116 via the optical system 114. At this point, the imaging device 116 has moved to the reading position. The imaging device 116 is formed with a line image sensor, for example, and generates an electrical signal in accordance with the intensity of the reflected light (or performs photoelectric conversion). The generated electrical signal is input to the image forming unit 130 after image processing. The image processing includes A/D conversion, shading correction, a filtering process, and an image compression process, for example.

<Operation Display Unit 120>

The operation display unit 120 includes a display and a keyboard, for example, or includes a touch panel, and functions as an input unit and an output unit. The keyboard includes keys, such as a select key for designating a sheet size, a numeric keypad for setting the number of copies to be made, a start key for issuing an operation start instruction, and a stop key for issuing an operation stop instruction. The input unit is used for a user to input characters, perform various settings, and issue (input) various instructions such as a start instruction. The output unit is used for presenting the device configuration, the progress of a print job, error occurrences, the currently alterable settings, and the like to the user.

<Image Forming Unit 130>

The image forming unit 130 uses an electrophotographic process to form an image on a paper sheet that is a recording medium. The image forming unit 130 includes an image forming unit 130A that forms a yellow (Y) image, an image forming unit 130B that forms a magenta (M) image, an image forming unit 130C that forms a cyan (C) image, and an image forming unit 130D that forms a black (K) image. The developer for the electrophotographic process contains, for example, non-magnetic toner and magnetic carriers.

The respective units in the image forming unit 130 each include a developing device 131, a photosensitive drum 132, a charging unit 133, and an optical writing unit 134.

The developing device 131 develops an electrostatic latent image formed on the photosensitive drum 132, and visualizes the electrostatic latent image with toner. Specifically, monochrome toner images that are a yellow image, a magenta image, a cyan image, and a black image are formed on the photosensitive drums 132 of the image forming units 130A, 130B, 130C, and 130D, respectively.

The photosensitive drum 132 is an image carrier with a photosensitive layer made of a resin such as polycarbonate containing an organic photoconductor (OPC), and is designed to rotate at a predetermined speed. The charging unit 133 includes a corona discharge electrode disposed in the vicinity of the photosensitive drum 132, and electrically charges the surface of the photosensitive drum 132 with generated ions.

The optical writing unit 134 has a scanning optical device incorporated thereinto. The optical writing unit 134 exposes the electrically-charged photosensitive drum 132 in accordance with a print job or image data from the image reading unit 110. By doing so, the optical writing unit 134 lowers the potential of the exposed portion, and forms the electrostatic latent image corresponding to the image data.

<Transfer Unit 140>

The transfer unit 140 includes an intermediate transfer belt 141, a primary transfer unit 142, and a secondary transfer unit 143. The intermediate transfer belt 141 is wound around the primary transfer unit 142 and rollers, and is movably supported. The primary transfer unit 142 includes primary transfer modules 142A, 142B, 142C, and 142D corresponding to yellow, magenta, cyan, and black. The secondary transfer unit 143 is disposed on the outer side of the intermediate transfer belt 141, and is positioned so that a paper sheet can pass between the secondary transfer unit 143 and the intermediate transfer belt 141.

The toner images formed in the respective colors in the image forming units 130A through 130D are sequentially transferred onto the intermediate transfer belt 141 by the primary transfer modules 142A through 142D. As a result, the respective layers of the yellow image, the magenta image, the cyan image, and the black image are superimposed, and thus, a color toner image is formed. The formed toner image is transferred onto the conveyed paper sheet by the secondary transfer unit 143.

<Fixing Unit 150>

The fixing unit 150 is used for fixing the color image transferred onto the paper sheet, and includes a heating roller 151 and a pressure roller 152. When the paper sheet passes between the heating roller 151 and the pressure roller 152, pressure and heat are applied to the paper sheet, to melt the toner and fix the color image to the paper sheet.

<Sheet Feeder Unit 160>

The sheet feeder unit 160 includes sheet feed trays 161A and 161B that store paper sheets P, feed rollers 162A and 162B, and separation rollers 163A and 163B. The feed roller 162A sends the paper sheets P from the sheet feed tray 161A to the sheet conveyance path of the sheet conveyance unit 170. The separation roller 163A separates the supplied paper sheets P from one another. The feed roller 162B and the separation roller 163B also have functions similar to those of the feed roller 162A and the separation roller 163A, respectively.

<Sheet Conveyance Unit 170>

The sheet conveyance unit 170 conveys paper sheets in the image forming apparatus 100. The sheet conveyance unit 170 includes a sheet conveyance path 171, conveyance rollers including resist rollers 172 and sheet discharge rollers 173, a reverse switching unit 174, a sheet catch tray 175, a sheet insertion tray 176, and a sheet detector. The sheet detector includes detection sensors. The detection sensors are disposed at predetermined positions in the sheet conveyance path 171, and are used together with the control unit 190 for detecting a paper jam in the sheet conveyance path 171. In this embodiment, the detection sensors are also used for detecting a paper sheet remaining in the sheet conveyance path 171 in the second sheet conveyance, which will be described later. The detection sensors will be described later in detail.

The sheet conveyance path 171 includes a guide member that guides a paper sheet P being conveyed. The above mentioned conveyance rollers are arranged in pairs along the guide member. Each of the conveyance rollers includes a drive unit (not shown), and conveys the paper sheet P along the sheet conveyance path 171 in accordance with an instruction from the control unit 190.

A paper sheet P supplied from the sheet feeder unit 160 is conveyed in a path that extends from a position A or B to a position G in the sheet conveyance unit 170 via positions C, D, and E, the resist rollers 172, the secondary transfer unit 143, the fixing unit 150, and the reverse switching unit 174. Alternatively, the paper sheet P is conveyed into an inversion path from the reverse switching unit 174. The inversion path is a path that extends from the reverse switching unit 174 to a position J via a position I, returns to the position I from the position J, and merges with the above mentioned path at the position D. The inversion path is used when a paper sheet P is turned over. For example, in a case where an image is to be printed on the back surface of a paper sheet P having an image already printed on the front surface, the control unit 190 controls the reverse switching unit 174 to guide the paper sheet P into the inversion path and convey the paper sheet P toward the position I. The control unit 190 then reverses the top and the bottom of the paper sheet P by conveying forward and then backward in the path between the positions I and J, and sends the paper sheet P to the position D via the position I.

A paper sheet supplied through the sheet insertion tray 176 is conveyed in a path that extends from a position H to the position G via the position E, the resist rollers 172, the secondary transfer unit 143, the fixing unit 150, and the reverse switching unit 174. Alternatively, the paper sheet P is conveyed into the inversion path from the reverse switching unit 174.

<Communication Unit 180>

The communication unit 180 connects to a client terminal such as a personal computer via a network, and transmits and receives data such as a print job. In cooperation with the control unit 190, the communication unit 180 functions as a job acquiring unit. The network may be a local area network (LAN), a wide area network (WAN) formed with LANs connected to one another by a dedicated line, the Internet, or a combination of these networks. The LAN standard is Ethernet (registered trademark), a token ring, or a fiber-distributed data interface (FDDI), for example. The communication protocol is TCP/IP (Transmission Control Protocol/Internet Protocol), for example.

<Control Unit 190>

The control unit 190 controls the image reading unit 110, the operation display unit 120, the image forming unit 130, the transfer unit 140, the fixing unit 150, the sheet feeder unit 160, the sheet conveyance unit 170, and the communication unit 180. As shown in FIG. 2, the control unit 190 includes an auxiliary storage device 191, a memory 192, a real-time clock (RTC) 193, and a central processing unit (CPU) 194. These components are connected in such a manner as to be able to communicate with one other via a bus 101. The control unit 190 serves as a print controller.

The auxiliary storage device 191 is a large-capacity storage device, such as a hard disk drive or a flash memory. The memory 192 includes a random access memory (RAM) and a read only memory (ROM) (not shown). The RAM stores data including results of operations performed by the CPU 194, and non-activation histories and a jam detection history with respect to the later described second sheet conveyance. The non-activation histories and the jam detection history will be described later. The auxiliary storage device 191 or the memory 192 also stores information about paper sheets that can be conveyed.

The RTC 193 has a timer function, and may be used for measuring time for stay monitoring jam timers and reaching jam timers that will be described later.

The CPU 194 executes a control program 195 for causing the image forming apparatus 100 to function. The control program 195 is stored in the auxiliary storage device 191, and is loaded into the RAM of the memory 192 when executed by the CPU 194. In accordance with the control program 195, the CPU 194 controls the image reading unit 110, the operation display unit 120, the image forming unit 130, the transfer unit 140, the fixing unit 150, the sheet feeder unit 160, the sheet conveyance unit 170, and the communication unit 180.

In this embodiment, after sheet conveyance is suspended due to a jam clearing process or the like, second sheet conveyance that differs from the sheet conveyance (first sheet conveyance) in a normal printing process is carried out when the suspension is lifted and the paper sheets remaining in the sheet conveyance path 171 are automatically discharged. In the first sheet conveyance, the control unit 190 conveys a paper sheet P in accordance with paper sheet information included in a print job. In the second sheet conveyance, on the other hand, the control unit 190 conveys a paper sheet P not in accordance with the paper sheet information but in accordance with a result of detection performed by the above mentioned sheet detector, so that the paper sheet P is automatically discharged to the outside of the image forming apparatus 100.

In this embodiment, all the paper sheets remaining in the sheet conveyance path 171 after sheet conveyance is suspended due to a jam clearing process or the like are regarded as invalid paper sheets and are discharged to the outside of the image forming apparatus 100, regardless of their courses to respective positions in the sheet conveyance path 171.

(Discharge of Remaining Paper Sheets by the Second Sheet Conveyance)

Referring now to FIGS. 3A through 3E, discharge of remaining paper sheets by the second sheet conveyance is described in detail. FIGS. 3A through 3E are schematic diagrams showing first through fifth example discharge paths according to this embodiment. In FIGS. 3A through 3E, positions A through J in the sheet conveyance path 171 correspond to the positions A through J in the sheet conveyance path 171 shown in FIG. 1. For the sake of simplicity, components such as the conveyance rollers are not shown in FIGS. 3A through 3E.

[Setting of Conveyance Sections]

In an example of this embodiment, the five conveyance sections (hereinafter also referred to simply as "sections") of conveyance sections 1 through 5 are set in the sheet conveyance path 171. For example, the section 1 is the portion from the position D to the position G, the section 2 is the portion from the position F to the position D, the section 3 is the portion from the position C to the position D, the section 4 is the portion from the position B to the position C, and the section 5 is the portion from the position A to the position C. The conveyance sections are not necessarily the above sections 1 through 5. The conveyance sections may be set as appropriate in accordance with the drive configuration of the image forming apparatus 100, the form of the sheet conveyance path 171, the conveyance conditions, and the like. For ease of explanation, any conveyance section is not set between the position H and the position E in the sheet conveyance path 171 shown in FIG. 1, but the portion between the position H and the position E may also be set as a conveyance section.

In the section 1, detection sensors $S_{11}$ through $S_{14}$ are disposed. Of these detection sensors, the detection sensor $S_{11}$ and $S_{12}$ are located on the downstream side and the upstream side of the reverse switching unit 174 in the sheet conveying direction, and detect a paper sheet P being conveyed in the section 1. Meanwhile, the detection sensor $S_{13}$ may be disposed in a portion between the secondary transfer unit 143 and the fixing unit 150 in the sheet conveyance path 171, and the detection sensor $S_{14}$ may be disposed at the position E in the sheet conveyance path 171.

In the section 2, detection sensor $S_{21}$ through $S_{26}$ are disposed. Of these detection sensors, the detection sensors $S_{21}$ through $S_{23}$ may be located between the position I and the position D, and the detection sensors $S_{24}$ through $S_{26}$ may be located between the position I and the position F. Furthermore, detection sensors $S_{31}$ and $S_{32}$ may be disposed in the section 3, and detection sensors $S_{41}$ and $S_{42}$ may be disposed in the section 4. Further, a detection sensor $S_{51}$ may be disposed in the section 5.

In the sheet conveyance path 171, the detection sensors $S_{11}$, $S_{12}$, $S_{14}$, and $S_{26}$ are disposed at portions that hinder automatic discharge of other paper sheets due to staying of a paper sheet P (these portions will be referred to as "restricted portions"), and detect a paper sheet P being conveyed through the restricted portions. In FIGS. 3A through 3E, the detection sensors located at the restricted portions are denoted by "▲", and the detection sensors located at unrestricted portions are denoted by "Δ". The detection sensors $S_{11}$ through $S_{51}$ may be transmissive or reflective optical sensors, for example.

In a case where sheet conveyance in the sheet conveyance path 171 is resumed after suspension, the control unit 190 controls the sheet conveyance unit 170 to perform the second sheet conveyance on the paper sheets remaining in the sheet conveyance path 171 and not hindering the sheet conveyance.

[Setting of Priority Order]

There may be more than one paper sheet remaining in the sheet conveyance path 171. In a case where paper sheets remain in more than one conveyance section, the paper sheet needs to be discharged in order from the downstream side which is close to the sheet catch tray 175. In this embodiment, priorities are given in descending order to the section 1, the section 2, the section 3, and the section 4, and the section 5, with the order of remaining paper sheet discharge from the respective conveyance sections being taken into account. However, the priority order is not necessarily the above order, and may be determined as appropriate in accordance with the drive configuration of the image forming apparatus 100, the form of the sheet conveyance path 171, the conveyance conditions, and the like.

[Setting of Discharge Paths]

Discharge paths for discharging remaining paper sheets onto the sheet catch tray 175 are set for the respective conveyance sections. A discharge path is formed with an allocated conveyance section and all the conveyance section(s) (the conveyance section(s) on the downstream side) existing between the conveyance section and the sheet catch tray 175. That is, in a case where a paper sheet remaining in a conveyance section is to be automatically discharged, conveyance is conducted in the conveyance section and the conveyance section(s) located on the downstream side of the conveyance section. Table 1 shows the sections, the priorities, and the discharge paths.

TABLE 1

| Section | Priority | Discharge path |
|---|---|---|
| Section 1 | 1 | First discharge path = section 1 |
| Section 2 | 2 | Second discharge path = section 2 + section 1 |
| Section 3 | 3 | Third discharge path = section 3 + section 1 |
| Section 4 | 4 | Fourth discharge path = section 4 + section 3 + section 1 |
| Section 5 | 5 | Fifth discharge path = section 5 + section 3 + section 1 |

<Method of Controlling the Image Forming Apparatus 100>

Figure 4:
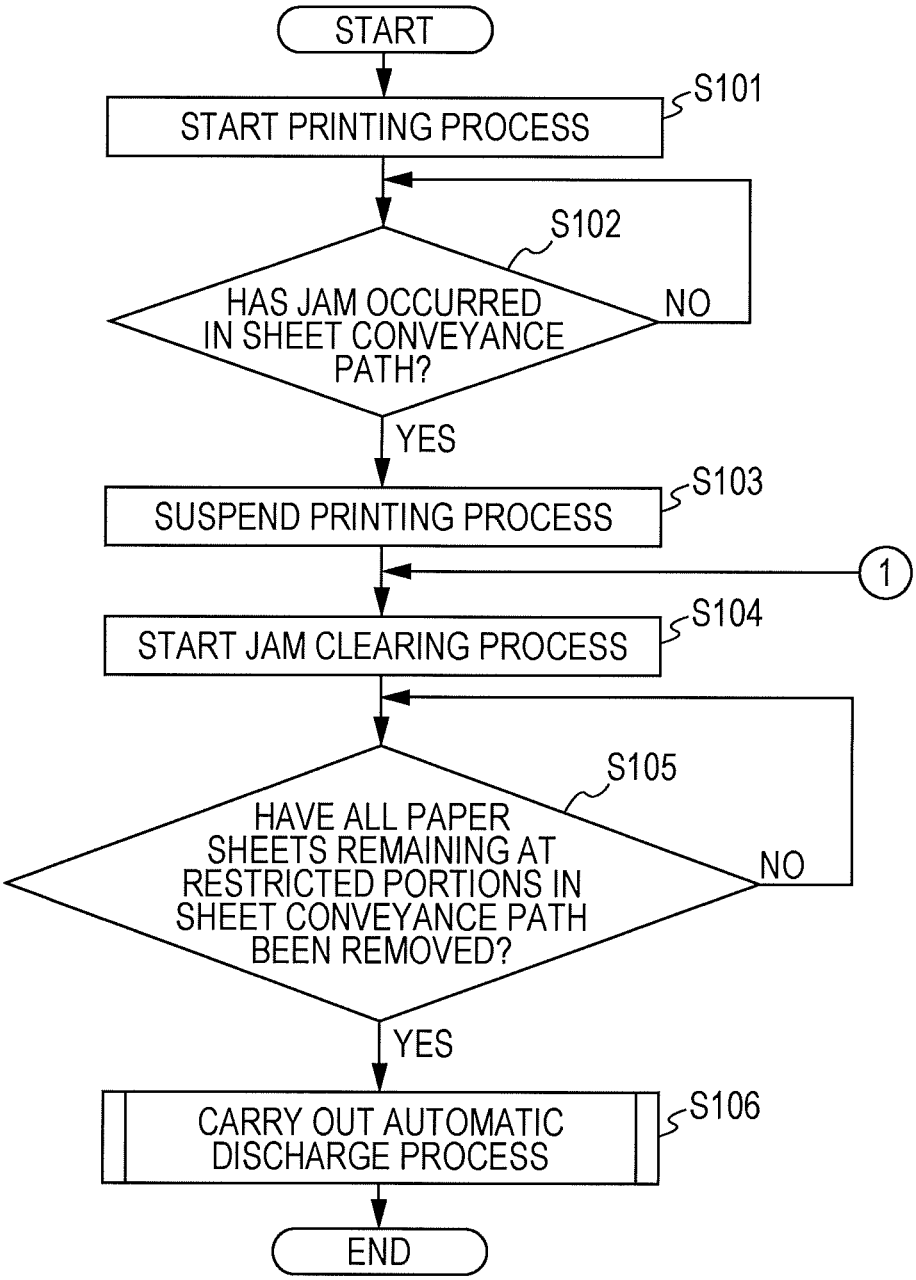
FIG. 4 is a flowchart showing an example outline of a method of controlling the image forming apparatus shown in FIG. 1.
Figure 5A:
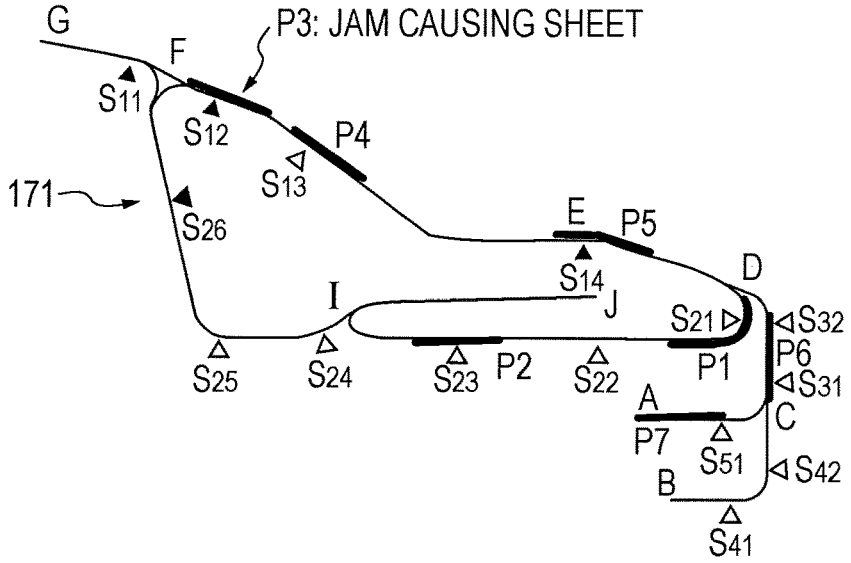
FIG. 5A is a schematic diagram showing an example of the states of paper sheets remaining in the sheet conveyance path immediately after the occurrence of a jam.
Figure 5B:
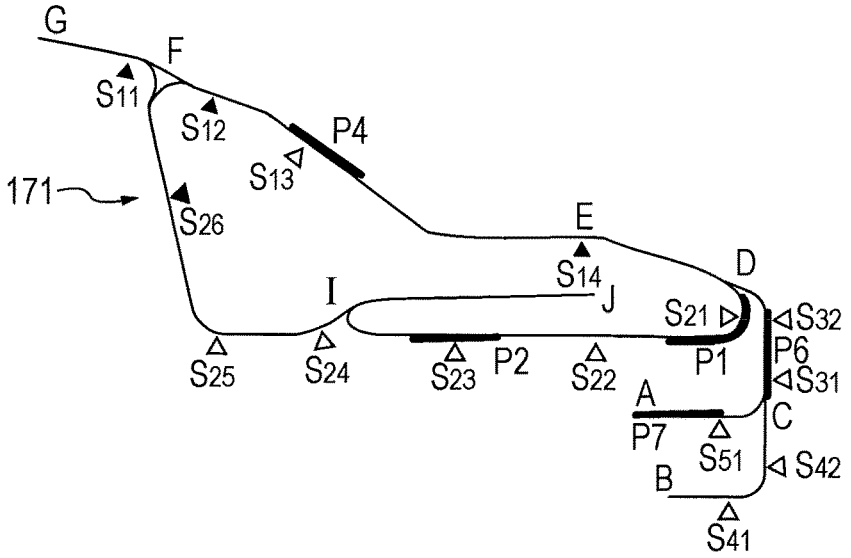
FIG. 5B is a schematic diagram showing an example of expected states of the remaining paper sheets that can be automatically discharged in the sheet conveyance path, after a user removes the paper sheets remaining at the restricted portions shown in FIG. 5A.
Figure 5C:
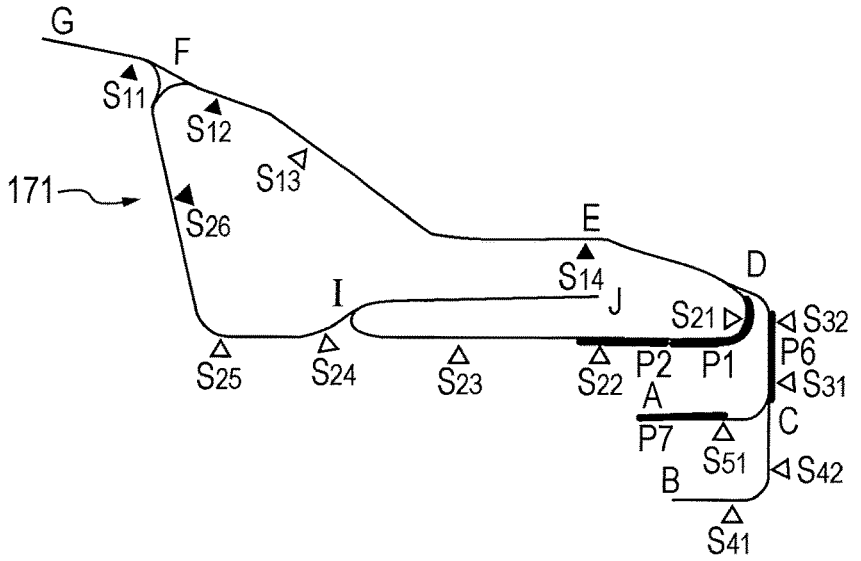
FIG. 5C is a schematic diagram showing an example case where the states of the remaining paper sheets that can be automatically discharged as shown in FIG. 5B have changed after the user removed the remaining paper sheets.

Referring now to FIGS. 4 through 5C, a method of controlling the image forming apparatus 100 of this embodiment is described. FIG. 4 is a flowchart showing an example outline of a method of controlling the image forming apparatus 100 shown in FIG. 1. FIGS. 5A through 5C are schematic diagrams showing examples of states of paper sheets remaining in the sheet conveyance path when a paper jam has occurred. FIG. 5A is a schematic diagram showing an example of the states of paper sheets remaining in the sheet conveyance path immediately after a paper jam has occurred. FIG. 5B is a schematic diagram showing an example of expected states of the remaining paper sheets that can be automatically discharged in the sheet conveyance path, after a user removes the paper sheets remaining at the restricted portions in FIG. 5A. FIG. 5C is a schematic diagram showing an example case where the states of the remaining paper sheets that can be automatically discharged as shown in FIG. 5B have changed after the user removed the remaining paper sheets. It should be noted that the control method according to this embodiment is implemented as the control program 195 is executed by the CPU 194.

As shown in FIG. 4, a printing process is first started (step S101). The control unit 190 receives a print job via the communication unit 180, and stores the received print job into the auxiliary storage device 191 or the memory 192. In accordance with the paper sheet information included in the print job, the control unit 190 controls the sheet feeder unit 160 and the sheet conveyance unit 170 so that the necessary number of paper sheets P are sent to the sheet conveyance path 171, and these paper sheets P are conveyed along the sheet conveyance path 171 (the first sheet conveyance is performed).

The control unit 190 then determines whether a paper jam has occurred in the sheet conveyance path 171 (step S102). Specifically, in accordance with the results of detection performed by the detection sensors disposed in the sheet conveyance path 171, the control unit 190 determines whether a paper jam has occurred in the sheet conveyance path 171. For example, in a case where the detection sensor at a first position in the sheet conveyance path 171 stays on over a predetermined period of time, the control unit 190 determines that a paper jam has occurred at the first position. If any paper jam has not occurred in the sheet conveyance path 171 (step S102: NO), the printing process is continued.

If a paper jam has occurred in the sheet conveyance path 171 (step S102: YES), on the other hand, the printing process is suspended (step S103). The control unit 190 controls the respective components of the image forming apparatus 100, to suspend the printing process. At this point, the sheet conveyance in the sheet conveyance path 171 is also suspended.

As shown in FIG. 5A, paper sheets P1 through P7 might remain in the sheet conveyance path 171 after the sheet conveyance is suspended due to the paper jam. Of these paper sheets, the paper sheet P3 is the jam causing sheet, the paper sheet P5 is a remaining paper sheet remaining at a restricted portion. Therefore, the paper sheet P3 and the paper sheet P5 need to be removed by the user. Meanwhile, the paper sheets P1, P2, P4, P6, and P7 remain at unrestricted portions, and are the remaining paper sheets that can be automatically discharged.

A jam clearing process is then started (step S104). In accordance with the above detection results, the control unit 190 causes the operation display unit 120 to display, on the display screen thereof, the positions of the above restricted portions including the position of the occurrence of the paper jam in the sheet conveyance path 171, and prompts the user to remove the remaining paper sheets such as the jam causing sheet remaining at the restricted portions. In the example case shown in FIG. 5A, the positions of the paper sheets P3 and P5, and a message to prompt the user to remove the paper sheets P3 and P5 are displayed, together with an illustrated method of removing paper sheets remaining in the sheet conveyance path 171, on the display screen.

In accordance with the message for removal of the remaining paper sheets, the user opens a door on the front of the image forming apparatus 100, for example. The user then pulls out the rack containing the sheet conveyance path 171, and removes the paper sheets P3 and P5 remaining at the restricted portions.

The control unit 190 then determines whether all the paper sheets remaining at the restricted portions in the sheet conveyance path 171 have been removed (step S105). If not all the paper sheets remaining at the restricted portions in the sheet conveyance path 171 have been removed (step S105: NO), the control unit 190 continues to prompt the user to remove the paper sheets remaining at the restricted portions. In the example case shown in FIG. 5A, the control unit 190 continues to prompt the user to remove the remaining paper sheets, until both the paper sheets P3 and P5 are removed.

If all the paper sheets remaining at the restricted portions in the sheet conveyance path 171 have been removed (step S105: YES), an automatic discharge process is carried out (step S106). In a case where the user has appropriately removed the paper sheets remaining at the restricted portions in accordance with the instruction displayed on the display screen of the operation display unit 120, the states of the remaining paper sheets that can be automatically discharged in the sheet conveyance path 171 are expected to be as shown in FIG. 5B. When removing the paper sheets P3 and P5, however, the user might notice the paper sheet P4 that can be automatically discharged, and inadvertently remove the paper sheet P4, for example, as shown in FIG. 5C. Furthermore, when operating a cancellation lever, for example, the user might greatly move the paper sheet P2 that can be automatically discharged, and cause a decrease in the distance between the paper sheet P2 and the paper sheet P1, or overlapping between the paper sheet P2 and the paper sheet P1.

To counter such unexpected situations, the image forming apparatus 100 performs the second sheet conveyance to automatically discharge the paper sheets remaining in the sheet conveyance path 171 to the outside of the image forming apparatus 100 in a case where suspended sheet conveyance in the sheet conveyance path 171 is resumed. In the second sheet conveyance, the paper sheets P1 through P7 remaining in the sheet conveyance path 171 are conveyed not in accordance with the paper sheet information included in the print job but in accordance with the results of detection performed by the sheet detector. Referring now to FIGS. 6 through 11B, the automatic discharge process in step S106 in FIG. 4 is described in detail.

<Automatic Discharge Process>

Figure 6:
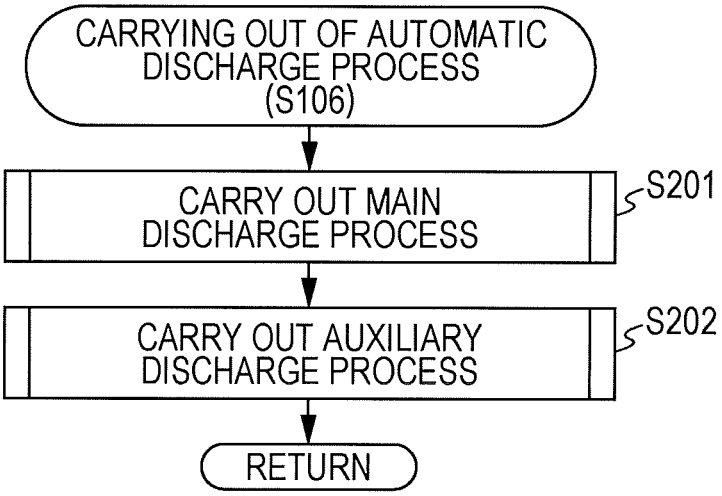
FIG. 6 is a subroutine flowchart showing an example of "carrying out of the automatic discharge process (step S106)" shown in FIG. 4.

FIG. 6 is a subroutine flowchart showing an example of "carrying out of the automatic discharge process (step S106)" shown in FIG. 4.

The automatic discharge process according to this embodiment may include the two steps: a main discharge process and an auxiliary discharge process. The main discharge process is a process of sequentially discharging paper sheets remaining in the sheet conveyance path 171 to the outside of the image forming apparatus 100 through the first through fifth discharge paths, in accordance with the priority order shown in Table 1.

Meanwhile, the auxiliary discharge process is an auxiliary process to be carried out in case remaining paper sheets cannot be detected because the installation interval between the detection sensors in the direction of conveyance of the remaining paper sheets is longer than each paper sheet remaining in the sheet conveyance path 171 in the sheet conveying direction, for example. The auxiliary discharge process can be skipped depending on conveyance conditions, such as the installation interval between the detection sensors and the length of each remaining paper sheet in the sheet conveying direction. In accordance with these conveyance conditions, the control unit 190 or the user may determine whether the auxiliary discharge process is to be carried out.

<Main Discharge Process (Step S201)>

Figure 7:
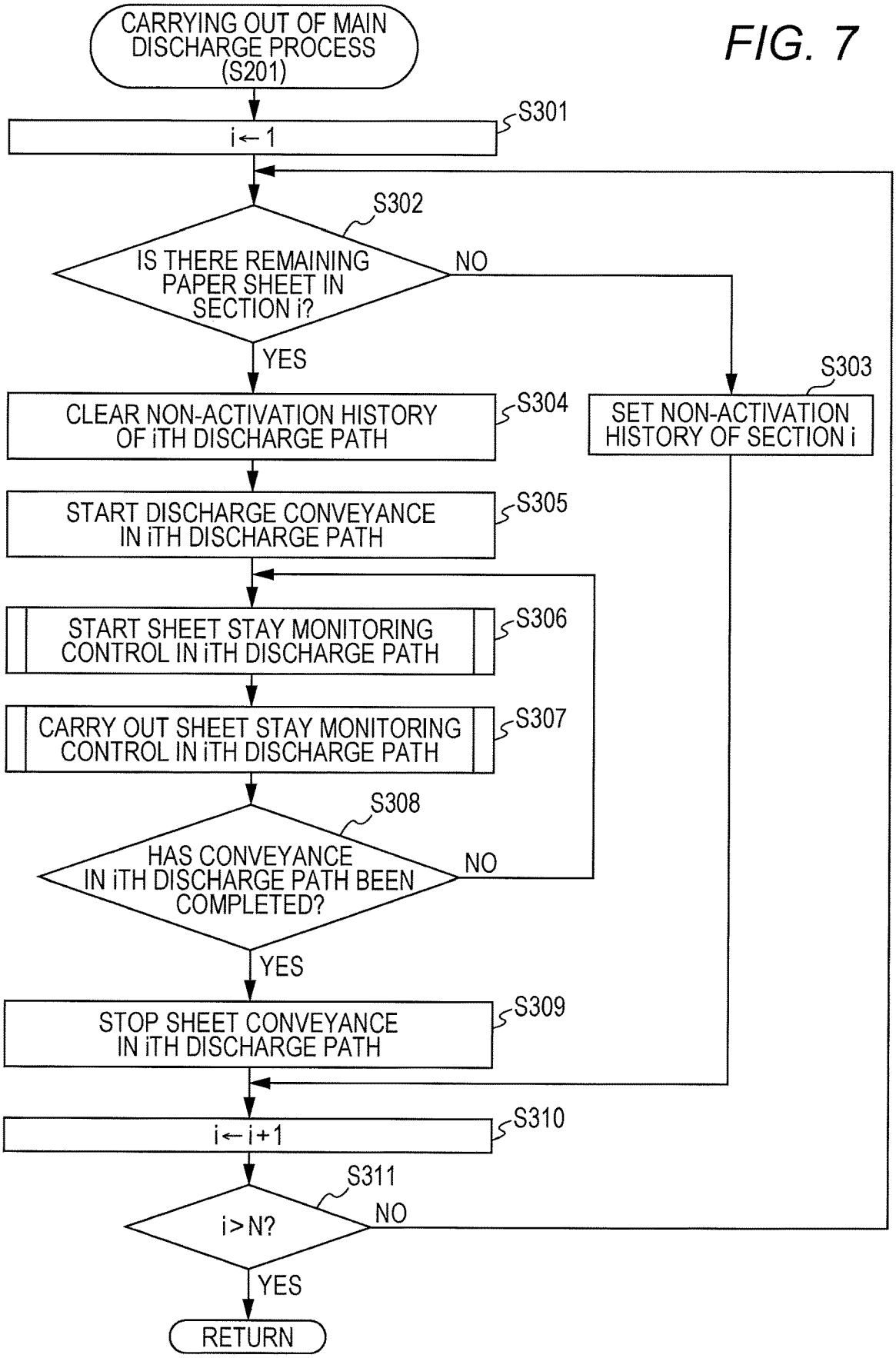
FIG. 7 is a subroutine flowchart showing an example of "carrying out of the main discharge process (step S201)" shown in FIG. 6.

FIG. 7 is a subroutine flowchart showing an example of "carrying out of the main discharge process (step S201)" shown in FIG. 6. In the process shown in the subroutine flowchart in FIG. 7, the presence or absence of remaining paper sheets in the respective conveyance sections of the sheet conveyance path 171 is checked, and the second sheet conveyance is performed in the discharge paths of the conveyance sections having paper sheets remaining therein. In the second sheet conveyance, discharge conveyance in the discharge paths is started so that discharge of the remaining paper sheets is started. Furthermore, the paper sheets remaining in the sheet conveyance path 171 are monitored until any remaining paper sheet is no longer detected in the discharge paths. This process is described below in greater detail.

First, "1" is assigned as the initial value to i (step S301). Here, i is the variable for indicating the number (1 to 5) assigned to a conveyance section.

A check is then made to determine whether there is a paper sheet remaining in the section i (step S302). The control unit 190 determines whether there is a paper sheet remaining in the section i, in accordance with results of detection performed by the detection sensors $S_{11}$ through $S_{51}$. If no paper sheets remain in the section i (step S302: NO), a non-activation history is set for the section i. The non-activation history is the history data for recording that sheet conveyance has not been started in the section i. The non-activation history is used in the auxiliary discharge process.

In the example case shown in FIG. 5C, there are remaining paper sheets in the section 2, the section 3, and the section 5, and there are no remaining paper sheets in the section 1 and the section 4. Accordingly, the section 1 and the section 4 are determined not to have any remaining paper sheet therein, and non-activation histories are set for the section 1 and the section 4. That is, the fact that sheet conveyance has not been started in the section 1 and the section 4 is recorded in the non-activation histories.

Next, 1 is added to i (step S310). By incrementing i, the control unit 190 moves on to the process for the next section.

Next, i is compared with N (step S311). In this embodiment, the sections 1 through 5 are formed in the sheet conveyance path 171 as described above. Accordingly, N is set at 5 in this case. If i is greater than 5, or if i is 6 or greater (step S311: YES), the main discharge process comes to an end (return). If i is not greater than 5, or if i is 5 or smaller (step S311: NO), the process moves on to step S302.

If there is a paper sheet remaining in the section (step S302: YES), on the other hand, the non-activation history of the ith discharge path is cleared (step S304). As described above, in a case where a paper sheet remaining in a section is to be automatically discharged, conveyance is conducted in the section and the conveyance section(s) located on the downstream side of the section. Accordingly, in a case where the non-activation history of the ith discharge path is cleared, the non-activation histories of the section i and the conveyance section(s) on the downstream side of the section i, which form the ith discharge path, are cleared. According to Table 1, for example, in a case where the non-activation history of the fifth discharge path is cleared, the non-activation histories of the section 5, the section 3, and the section 1 are cleared.

Next, discharge conveyance in the ith discharge path is started (step S305). The control unit 190 conducts conveyance in the sections included in the ith discharge path, or activates the drive system including the conveyance rollers of the sheet conveyance unit 170 and the like. In a case where discharge conveyance in the fifth discharge path is started, for example, the drive system formed with the conveyance rollers and the like in the section 5, the section 3, and the section 1 is activated. In the example case shown in FIG. 5C, there are remaining paper sheets in the section 2, the section 3, and the section 5. Accordingly, discharge conveyance is started in the second discharge path, the third discharge path, and the fifth discharge path in this order. Table 2 shows the sections, the priority order, the detected remaining paper sheet(s), the discharge paths, and the discharge order in the example case shown in FIG. 5C.

TABLE 2

| Section | Priority | Remaining sheet detected | Discharge path | Discharge order |
|---|---|---|---|---|
| Section 1 | 1 | Not detected | First discharge path = section 1 | — |
| Section 2 | 2 | Detected | Second discharge path = section 2 + section 1 | 1 |
| Section 3 | 3 | Detected | Third discharge path = section 3 + section 1 | 2 |
| Section 4 | 4 | Not detected | Fourth discharge path = section 4 + section 3 + section 1 | — |
| Section 5 | 5 | Detected | Fifth discharge path = section 5 + section 3 + section 1 | 3 |

Sheet stay monitoring control in the ith discharge path sheet is then started (step S306). The control unit 190 monitors the states of the respective detection sensors in the direction from the most upstream side to the most downstream side in the ith discharge path, and starts the stay monitoring control on the detected remaining paper sheets. The process in step 306 will be described later in detail.

Sheet stay monitoring control in the ith discharge path sheet is then carried out (step S307). The control unit 190 determines whether the remaining paper sheets are being properly conveyed, by measuring the staying times of remaining paper sheets at the respective detection sensors, and the reaching time required for a remaining paper sheet to reach the adjacent detection sensor on the downstream side. If a paper jam has occurred in the sheet conveyance path 171, the sheet conveyance is stopped. The process in step S307 will be described in detail.

A check is then made to determine whether the conveyance in the ith discharge path has been completed (step S308). If the conveyance in the ith discharge path has not been completed (step S308: NO), the process moves on to step S306.

If the conveyance in the ith discharge path has been completed (step S308: YES), on the other hand, the sheet conveyance in the ith discharge path is stopped (step S309). The process then moves on to step S310, which has been described above. When the automatic discharge of remaining paper sheets from all the sections i is completed, the process comes to an end (return).

The control unit 190 monitors each paper sheet remaining in the ith discharge path for a conveyance error. When completing the conveyance error monitoring of all the paper sheets remaining in the ith discharge path, the control unit 190 determines that the automatic discharge of the paper sheets remaining in the ith discharge path has been completed. The specific process of monitoring for conveyance errors in the ith discharge path will be described below.

<Start of Sheet Stay Monitoring Control in the Ith Discharge Path (Step S306)>

Figure 8:
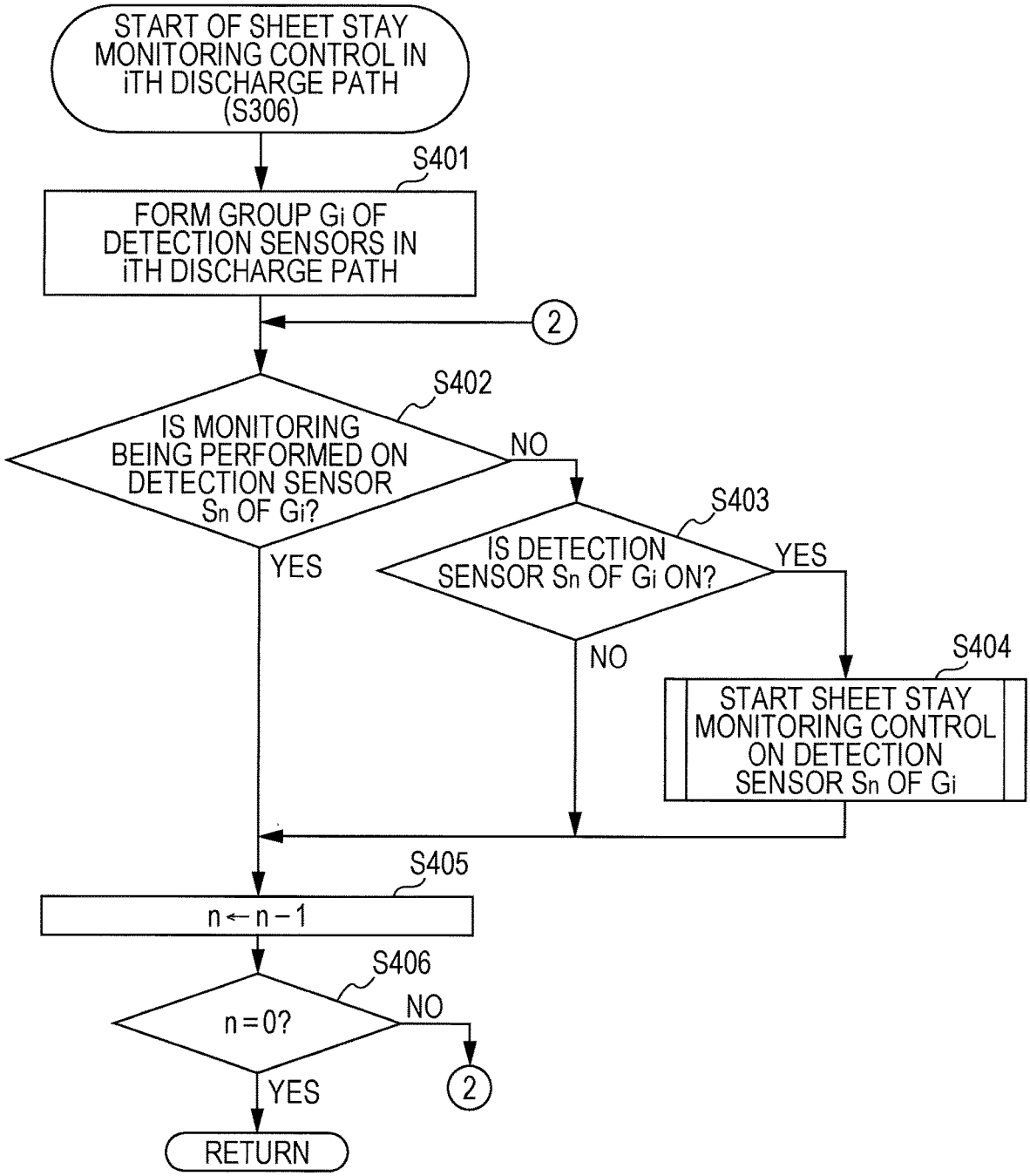
FIG. 8 is a subroutine flowchart showing an example of "start of sheet stay monitoring control in the ith discharge path (S306)" shown in FIG. 7.

FIG. 8 is a subroutine flowchart showing an example of "start of the sheet stay monitoring control in the ith discharge path (S306)" shown in FIG. 7. In the process shown in the subroutine flowchart in FIG. 8, a group of detection sensors installed in the ith discharge path is formed, and stay monitoring control on the paper sheets remaining in the ith discharge path is started with the group of detection sensors. The monitoring control is started every time a remaining paper sheet is detected in the ith discharge path.

First, a group of detection sensors in the ith discharge path is formed (step S401). More specifically, the control unit 190 forms a group $G_i$ of detection sensors from the most upstream side to the most downstream side in the ith discharge path. For example, the group $G_5$ in the fifth discharge path is formed with the detection sensors $S_{51}$, $S_{32}$, $S_{31}$, $S_{14}$, $S_{13}$, $S_{12}$, and $S_{11}$. In this case, the total number of the detection sensors is 7, and the detection sensor located on the most upstream side in the group $G_5$ is the detection sensor $S_{51}$. Where the nth detection sensor of the group $G_i$ is represented by $S_n$, $G_5$ $(S_7, \ldots, S_2, S_1)=(S_{51}, S_{32}, S_{31}, S_{14}, S_{13}, S_{12}, S_{11})$. The number 7 of the most upstream detection sensor in the fifth discharge path is set as the initial value of n, so that the remaining sheet stay monitoring is performed in the direction from the most upstream side toward the most downstream side in the fifth discharge path.

A check is then made to determine whether monitoring is being performed on the detection sensor $S_n$ of the group $G_i$ (step S402). In determining whether monitoring is being performed on the detection sensor $S_n$ of the group $G_i$, the control unit 190 determines whether the stay monitoring jam timer of the detection sensor $S_n$ of the group $G_i$ is in operation, or whether the reaching jam timer of the detection sensor $S_{n-1}$ of the group $G_i$ is in operation.

The stay monitoring jam timer is the timer for measuring the staying time over which a remaining paper sheet being conveyed in the sheet conveyance path 171 stays within the detection range of the detection sensor $S_n$ in the sheet conveyance path 171. One stay monitoring jam timer is employed for each one of the detection sensors (the detection sensors $S_{51}$, $S_{32}$, $S_{31}$, $S_{14}$, $S_{13}$, $S_{12}$, and $S_{11}$, for example). The reaching jam timer is the timer for measuring the period from the time when a remaining paper sheet being conveyed in the sheet conveyance path 171 is detected by the detection sensor $S_n$, to the time when the remaining paper sheet is detected by the adjacent detection sensor $S_{n-1}$ on the downstream side.

If monitoring is being performed on the detection sensor $S_n$ of the group $G_i$ (step S402: YES), n is subtracted from 1 (step S405). By decrementing n, the control unit 190 moves on to the process for the adjacent detection sensor on the downstream side.

A check is then made to determine whether n is 0 (step S406). If n is 0 (step S406: YES), the remaining sheet stay monitoring at the detection sensor $S_i$ located on the most downstream side in the ith discharge path has been completed, and therefore, the process comes to an end (return). If n is not 0 (step S406: NO), on the other hand, the process moves on to step S402.

If monitoring is not being performed on the detection sensor $S_n$ of the group $G_i$ (step S402: NO), a check is made to determine whether the detection sensor $S_n$ of the group $G_i$ is on (step S403). The control unit 190 determines whether the detection sensor $S_n$ of the group $G_i$ is on, or whether the detection sensor $S_n$ is searching for a remaining paper sheet. If the detection sensor $S_n$ is not on, or if the detection sensor $S_n$ is off (step S403: NO), the process moves on to step S405.

If the detection sensor $S_n$ of the group $G_i$ is on (step S403: YES), on the other hand, the sheet stay monitoring control on the detection sensor $S_n$ of the group $G_i$ is started (step S404). The process then moves on to step S405.

<Start of the Sheet Stay Monitoring Control on the Detection Sensor $S_n$ of the Group $G_i$ (S404)>

Figure 9:
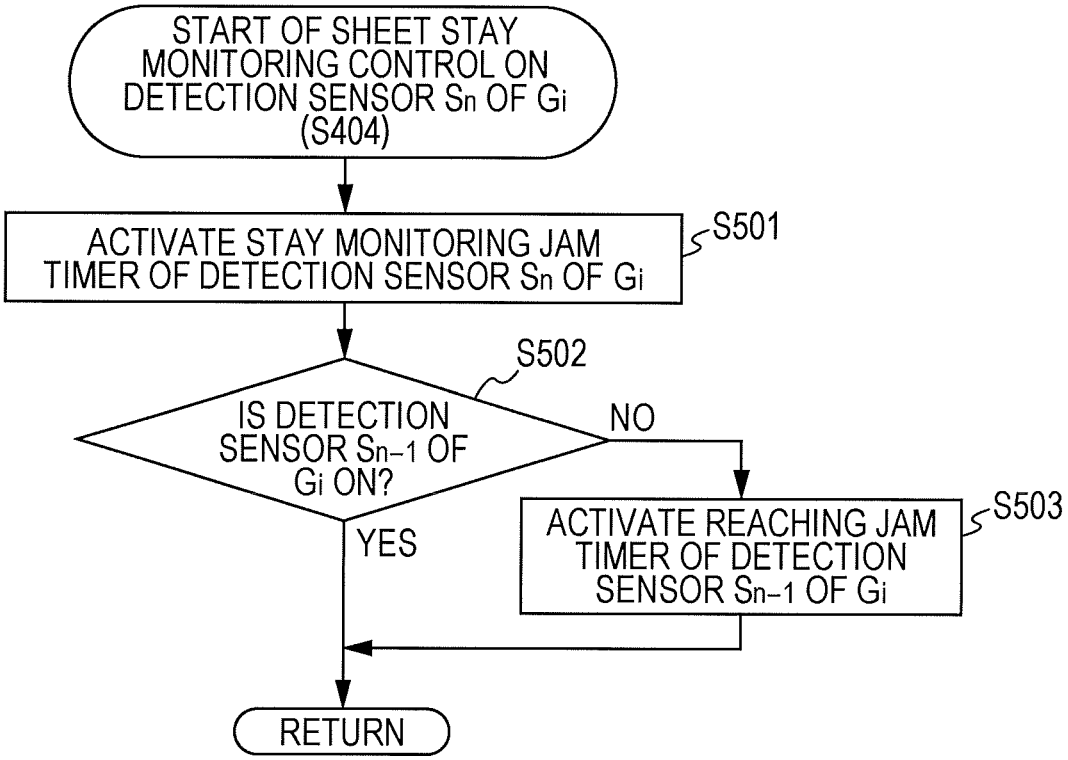
FIG. 9 is a subroutine flowchart showing an example of "start of the sheet stay monitoring control on the detection sensor $S_n$ of the group $G_i$ (S404)" shown in FIG. 8.

FIG. 9 is a subroutine flowchart showing an example of "start of the sheet stay monitoring control on the detection sensor $S_n$ of the group $G_i$ (S404)" shown in FIG. 8.

First, the stay monitoring jam timer of the detection sensor $S_n$ of the group $G_i$ is activated (step S501). Using a timer such as the RTC 193, the control unit 190 starts measuring the length of time during which the detection sensor $S_n$ stays on.

A check is then made to determine whether the detection sensor $S_{n-1}$ of the group $G_i$ is on (step S502). The control unit 190 determines whether the adjacent detection sensor $S_{n-1}$ on the downstream side of the detection sensor $S_n$ is on. If the detection sensor $S_{n-1}$ of the group $G_i$ is on (step S502: YES), the process comes to an end (return).

If the detection sensor $S_{n-1}$ of the group $G_i$ is not on, or if the detection sensor $S_{n-1}$ is off (step S502: NO), on the other hand, the reaching jam timer of the detection sensor $S_{n-1}$ of the group $G_i$ is activated (step S503). Using a timer such as the RTC 193, the control unit 190 starts measuring the length of time until the detection sensor $S_{n-1}$ switches from the off-state to the on-state, or the length of time until a remaining paper sheet detected by the detection sensor $S_n$ reaches the adjacent detection sensor $S_{n-1}$ on the downstream side. The process then comes to an end (return).

<Carrying Out of the Sheet Stay Monitoring Control in the ith Discharge Path (step S307)>

FIG. 10 is a subroutine flowchart showing an example of "carrying out of the sheet stay monitoring control in the ith discharge path (S307)" shown in FIG. 7. In the subroutine flowchart shown in FIG. 10, after the remaining sheet stay monitoring control is carried out on the detection sensor $S_n$, the remaining sheet reaching monitoring control is carried out on the detection sensor $S_{n-1}$. A check is then made to determine whether a paper jam has been detected. If a paper jam has been detected, the sheet conveyance is suspended. This process is described below in greater detail.

First, a check is made to determine whether the detection sensor $S_n$ of the group $G_1$ is off (step S601). If the detection sensor $S_n$ of the group $G_1$ is not off (step S601: NO), the control unit 190 determines that a remaining paper sheet stays at the position of the detection sensor $S_n$.

A check is then made to determine whether the time set in the stay monitoring jam timer of the detection sensor $S_n$ of the group $G_i$ has elapsed (step S602). The control unit 190 determines whether a predetermined staying time has elapsed since the stay monitoring jam timer of the detection sensor $S_n$ turned on. If the time set in the stay monitoring jam timer of the detection sensor $S_n$ has not elapsed yet (step S602: NO), the process moves on to step S601.

The predetermined staying time is set in accordance with the speed of conveyance of the remaining paper sheet, the size of the remaining paper sheet, and the like. It should be noted that the size of the paper sheet remaining in the sheet conveyance path 171 is stored into the auxiliary storage device 191 or the memory 192 when the sheet conveyance in the sheet conveyance path 171 is suspended. The predetermined staying time is set to cope with a situation where the distance between the preceding remaining paper sheet P1 and the succeeding remaining paper sheet P2 is short, as in the case with the remaining paper sheets P1 and P2 shown in FIG. 5C. If the above distance is 0, or if the remaining paper sheets P1 and P2 are successively conveyed, a remaining paper sheet appears to the detection sensor $S_n$ twice as long. To counter this, the predetermined staying time is set in accordance with the time required for two remaining paper sheets to successively pass through the position of the detection sensor $S_n$, for example. Here, the two remaining paper sheets should have the greatest length in the sheet conveying direction among the remaining paper sheets. Furthermore, the predetermined staying time may be set in accordance with the time required for two paper sheets to successively pass through the position of the detection sensor $S_n$. Here, the two paper sheets should have the greatest length in the sheet conveying direction among the paper sheets that can be conveyed in the sheet conveyance path 171.

If the time set in the stay monitoring jam timer of the detection sensor $S_n$ of the group $G_i$ has elapsed (step S602: YES), a jam detection history is set (step S603). The control unit 190 determines that a paper jam is likely to have occurred in the position of the detection sensor $S_n$ in the sheet conveyance path 171, and therefore, sets the jam detection history. The jam detection history is the history data for recording that a paper jam has been detected in the sheet conveyance path 171.

If the detection sensor $S_n$ of the group $G_i$ is off (step S601: YES), on the other hand, the stay monitoring jam timer of the detection sensor $S_n$ of the group $G_i$ is cleared (step S604).

A check is then made to determine whether the detection sensor $S_{n-1}$ of the group $G_i$ is on (step S605). If the detection sensor $S_{n-1}$ of the group $G_i$ is not on, or if the detection sensor $S_{n-1}$ of the group $G_i$ is off (step S605: NO) the control unit 190 determines that the remaining paper sheet has not reached the position of the detection sensor $S_{n-1}$.

A check is then made to determine whether the time set in the reaching jam timer of the detection sensor $S_{n-1}$ of the group $G_i$ has elapsed (step S606). The control unit 190 determines whether a predetermined reaching time has passed since the reaching jam timer of the detection sensor $S_{n-1}$ started measuring time. If the time set in the reaching jam timer of the detection sensor $S_{n-1}$ has not elapsed yet (step S606: NO), the process moves on to step S605. The predetermined reaching time may be set in accordance with the speed of conveyance of the remaining paper sheet and the installation interval between the detection sensors.

If the time set in the reaching jam timer of the detection sensor $S_{n-1}$ has elapsed (step S606: YES), a jam detection history is set (step S609). The control unit 190 determines that a paper jam is likely to have occurred between the detection sensor $S_n$ and the detection sensor $S_{n-1}$ in the sheet conveyance path 171, and therefore, sets the jam detection history.

If the detection sensor $S_{n-1}$ of the group $G_i$ is on (step S605: YES), on the other hand, the reaching jam timer of the detection sensor $S_{n-1}$ of the group $G_i$ is cleared (step S608).

A check is then made to determine whether there is a jam detection history (step 610). If there is no jam detection history (step 610: NO), the control unit 190 ends the process (return).

If there is a jam detection history (step 610: YES), on the other hand, the control unit 190 suspends the sheet conveyance (step S611). The process then moves on to step S104 in FIG. 4.

As described above, in this embodiment, conveyance errors in the respective remaining paper sheets to be automatically discharged, or the remaining paper sheets staying in the sheet conveyance path 171 are monitored. When conveyance error monitoring has been completed on all the remaining paper sheets, the automatic discharge of all the remaining paper sheets is determined to have been completed.

<Carrying Out of the Auxiliary Discharge Process (S202)>

Figure 11A:
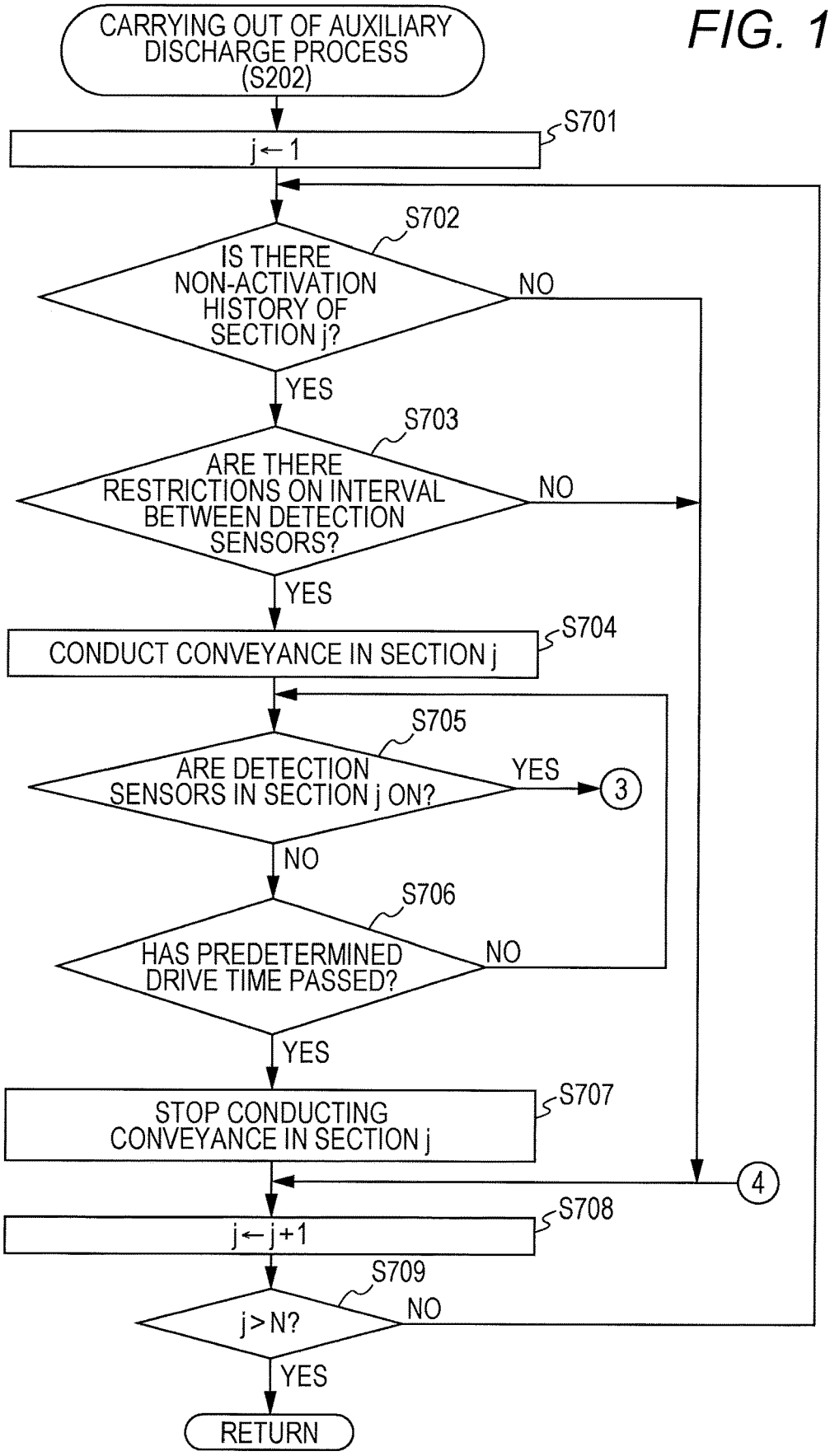
FIG. 11A is a subroutine flowchart showing an example of "carrying out of the auxiliary discharge process (step S202)" shown in FIG. 6.
Figure 11B:
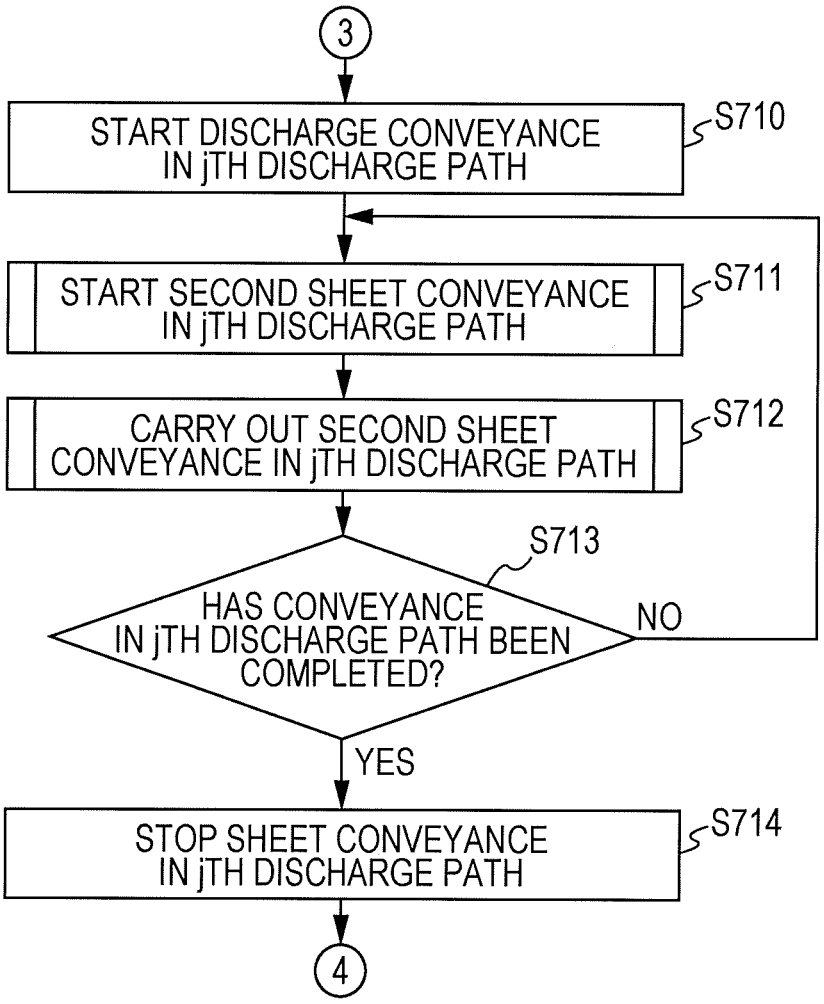
FIG. 11B is a subroutine flowchart that follows the subroutine flowchart shown in FIG. 11A.

FIG. 11A is a subroutine flowchart showing an example of the "carrying out of the auxiliary discharge process (S202)" shown in FIG. 6. FIG. 11B is a subroutine flowchart that follows the subroutine flowchart shown in FIG. 11A. In the auxiliary discharge process, when there is a possibility that any remaining paper sheet cannot be detected due to the installation interval between the detection sensors in a non-activation conveyance section, conveyance in the conveyance section is attempted for a predetermined drive time. If a remaining paper sheet is detected in the conveyance section, the second sheet conveyance is performed in the discharge path corresponding to the conveyance section. This process is described below in greater detail.

First, "1" is assigned as the initial value to j (step S701). Here, j is the variable for indicating the number (1 to 5) assigned to a conveyance section.

A check is then made to determine whether there is a non-activation history of the section j (step S702). The control unit 190 determines whether the section j has a non-activation history. If the section j has no non-activation history (step S702: NO), 1 is added to j (step S708). By incrementing j, the control unit 190 moves on to the process for the next section.

Next, j is compared with N (step S709). In this embodiment, the sections 1 through 5 are formed in the sheet conveyance path 171 as described above. Accordingly, N is set at 5 in this case. If j is greater than 5, or if j is 6 or greater (step S709: YES), the control unit 190 ends the process (return). If j is not greater than 5, or if j is 5 or smaller (step S709: NO), the process moves on to step S702.

If there is a non-activation history of the section j (step S702: YES), on the other hand, a check is made to determine whether there is any restriction on the interval between detection sensors (step S703). The control unit 190 determines whether there is a possibility that remaining paper sheets cannot be detected since the installation interval between the detection sensors in the direction of conveyance of the remaining paper sheets is longer than each remaining paper sheet in the sheet conveying direction. If there is no restriction on the interval between the detection sensors (step S703: NO), the process moves on to step S708.

If there are restrictions on the interval between the detection sensors (step S703: YES), the conveyance in the section j is conducted (step S704). The control unit 190 controls the sheet conveyance unit 170 to conduct the conveyance in the section j.

A check is then made to determine whether the detection sensors in the section j are on (step S705). If the detection sensors in the section j are not on, or if all the detection sensors in the section j are off (step S705: NO), a check is made to determine whether the predetermined drive time has passed (step S706). If there is a possibility that any remaining paper sheet cannot be detected due to the installation interval between the detection sensors, the control unit 190 conducts conveyance in the section j only for the predetermined drive time, and attempts to detect any undetected remaining paper sheet.

If the predetermined drive time has not passed (step S706: NO), the process moves on to step S705.

If the predetermined drive time has passed (step S706: YES), conducting of the conveyance in the section j is stopped (step S707). The process then moves on to step S708.

If the detection sensors in the section j are on (step S705: YES), discharge conveyance in the jth discharge path is started (step S710). The control unit 190 conducts conveyance in the sections included in the jth discharge path, or activates the drive system including the conveyance rollers of the sheet conveyance unit 170 and the like.

Sheet stay monitoring control in the jth discharge path sheet is then started (step S711). The control unit 190 monitors the states of the respective detection sensors in the direction from the most upstream side to the most downstream side in the jth discharge path, and starts the stay monitoring control on the detected remaining paper sheets. This process is the same as the process in step S306, and therefore, the explanation thereof is not repeated herein.

Sheet stay monitoring control in the jth discharge path sheet is then carried out (step S712). The control unit 190 determines whether a paper jam due to a remaining paper sheet has occurred in the sheet conveyance path 171, by measuring the staying times of remaining paper sheets at the respective detection sensors, and the reaching time required for a remaining paper sheet to reach the adjacent detection sensor on the downstream side. If a paper jam has occurred, the sheet conveyance is suspended. This process is the same as the process in step S307, and therefore, the explanation thereof is not repeated herein.

A check is then made to determine whether the conveyance in the jth discharge path has been completed (step S713). If the conveyance in the jth discharge path has not been completed (step S713: NO), the process moves on to step S711.

If the conveyance in the jth discharge path has been completed (step S713: YES), on the other hand, the sheet conveyance in the jth discharge path is stopped (step S714). The process then moves on to step S708, which has been described above. When the automatic discharge of remaining paper sheets from all the sections j is completed, the process comes to an end (return).

The image forming apparatus 100 and the control program 195 of this embodiment described so far achieve the effects described below.

In a case where sheet conveyance in the sheet conveyance path 171 is resumed after suspension, the control unit 190 controls the sheet conveyance unit 170 to perform the second sheet conveyance on the paper sheets remaining in the sheet conveyance path 171 and not hindering the sheet conveyance. Accordingly, the remaining paper sheets that can be automatically discharged in the sheet conveyance path 171 can be discharged to the outside of the image forming apparatus 100, not in accordance with the paper sheet information included in the print job, but in accordance with results of detection performed by the sheet detector. Thus, even if there is a change in the states of the remaining paper sheets that can be automatically discharged in the sheet conveyance path 171, the remaining paper sheets that can be automatically discharged can be conveyed without fail, and be discharged to the outside of the image forming apparatus 100.

Even in a case where the installation interval between the detection sensors in the direction of conveyance of remaining paper sheets is longer than each remaining paper sheet in the sheet conveying direction, the remaining paper sheets that can be automatically discharged can be conveyed without fail, and be discharged to the outside of the image forming apparatus 100.

Furthermore, while the second sheet conveyance is being performed, the staying time and the reaching time at the installation position of each detection sensor are measured with respect to each remaining paper sheet being conveyed in the sheet conveyance path 171. Thus, a paper jam can be detected in the sheet conveyance path 171. Moreover, a check can be made to determine whether a paper jam has occurred, with the speed of conveyance of remaining paper sheets and the lengths of remaining paper sheets of different sizes in the direction of conveyance in the sheet conveyance path 171 being taken into account.

Further, a check can be made to determine whether a paper jam has occurred, even in a case where two remaining paper sheets overlapping each other are conveyed, or where two remaining paper sheets are successively conveyed without any intermission.

Furthermore, priorities and discharge paths are set for the respective conveyance sections defined in the sheet conveyance path 171, and remaining paper sheets are discharged to the outside of the image forming apparatus 100 through the discharge paths in accordance with the priority order. Thus, all the remaining paper sheets can be discharged without fail.

An image forming apparatus and a control program according to an embodiment of the present invention have been described so far. However, it should be easy for those skilled in the art to add, modify, or omit any appropriate element in the above embodiment within the scope of the technical idea of the present invention.

For example, in the above described example case of the embodiment, sheet conveyance is resumed after the first sheet conveyance is suspended due to a paper jam in the sheet conveyance path. However, the present invention is not limited to such a case, and can be applied in cases where sheet conveyance is resumed after the first sheet conveyance is suspended due to various factors. For example, the present invention can be applied in a case where the power supply to an image forming apparatus is switched off to stop the image forming apparatus, after the first sheet conveyance is suspended and the sheet conveyance is stopped due to a paper jam in the sheet conveyance path. In this case, the power supply to the image forming apparatus is again switched on to activate the image forming apparatus, and the sheet conveyance is resumed. The present invention can be applied in such a case.

The present invention can also be applied in a case where the power supply to an image forming apparatus is switched on to activate the image forming apparatus, and sheet conveyance is resumed, after the power supply to the image forming apparatus is switched off and stopped while the first sheet conveyance is being performed. In such cases, the control unit can control the sheet conveyance unit so that the second sheet conveyance can be performed on the remaining paper sheets that do not hinder sheet conveyance, after the remaining paper sheets that hinder the sheet conveyance are removed by the user.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a sheet conveyance unit configured to include a sheet conveyance path and convey a sheet along the sheet conveyance path;

a sheet detector configured to detect the sheet in the sheet conveyance path;

a job acquiring unit configured to acquire a print job related to the sheet;

an image forming unit configured to form an image on the sheet; and a processor configured to:

control the sheet conveyance unit to perform one of first sheet conveyance and second sheet conveyance, wherein the first sheet conveyance conveys the sheet along the sheet conveyance path in accordance with sheet information included in the print job, and the second sheet conveyance discharges the sheet to outside the image forming apparatus in accordance with a result of detection performed by the sheet detector, regardless of the sheet information, wherein when sheet conveyance in the sheet conveyance path is resumed after a suspension, and the sheet detector detects a sheet in a section of the conveyance path, control the sheet conveyance unit to perform the second sheet conveyance on the detected sheet which remains in the sheet conveyance path and so as not to hinder the sheet conveyance resumed after suspension, and when sheet conveyance in the sheet conveyance path is resumed after the suspension, and the sheet detector does not detect the sheet in the section of the sheet conveyance path, control the sheet conveyance unit to activate the sheet conveyance unit in the section and then determine if the sheet is detected by the sheet detector, and if the sheet is detected after activation of the sheet conveyance unit, perform the second sheet conveyance on the detected sheet which remains in the section of the sheet conveyance path and so as not to hinder the sheet conveyance resumed after suspension.

2. The image forming apparatus according to claim 1, wherein when the sheet conveyance in the sheet conveyance path is resumed after the first sheet conveyance is suspended due to a paper jam in the sheet conveyance path, the processor controls the sheet conveyance unit to perform the second sheet conveyance on a remaining sheet which remains in the sheet conveyance path and does not hinder the sheet conveyance, after a remaining sheet hindering the sheet conveyance is removed by a user.

3. The image forming apparatus according to claim 1, wherein when a power supply to the image forming apparatus is switched on to activate the image forming apparatus and resume the sheet conveyance in the sheet conveyance path after the power supply to the image forming apparatus is switched off to stop the image forming apparatus while the first sheet conveyance is being performed or the first sheet conveyance is suspended to stop the sheet conveyance due to a paper jam in the sheet conveyance path, the processor controls the sheet conveyance unit to perform the second sheet conveyance on a remaining sheet not hindering the sheet conveyance, after a remaining sheet hindering the sheet conveyance is removed by a user.

4. An image forming apparatus, comprising:

a sheet conveyance unit configured to include a sheet conveyance path and convey a sheet along the sheet conveyance path;

a sheet detector configured to detect the sheet in the sheet conveyance path;

a job acquiring unit configured to acquire a print job related to the sheet;

an image forming unit configured to form an image on the sheet; and a processor configured to control the sheet conveyance unit to perform one of first sheet conveyance and second sheet conveyance, the first sheet conveyance being performed to convey the sheet along the sheet conveyance path in accordance with sheet information included in the print job, the second sheet conveyance being performed to discharge the sheet to outside in accordance with a result of detection performed by the sheet detector, regardless of the sheet information, wherein when sheet conveyance in the sheet conveyance path is resumed after a suspension, the processor controls the sheet conveyance unit to perform the second sheet conveyance on a remaining sheet which remains in the sheet conveyance path and does not hinder the sheet conveyance resumed after suspension, wherein while the second sheet conveyance is being performed, the processor determines whether a remaining sheet is being properly conveyed, in accordance with a staying time during which the remaining sheet stays at a first position in the sheet conveyance path, and a reaching time required for the remaining sheet to be conveyed from the first position to a second position located on a downstream side of the first position in a sheet conveying direction, the staying time and the reaching time being determined with respect to each remaining sheet being conveyed in the sheet conveyance path.

5. The image forming apparatus according to claim 4, wherein the sheet detector includes a plurality of detection sensors including first and second detection sensors disposed at the first and second positions, respectively, and the processor acquires the staying time by measuring a time during which the remaining sheet being conveyed in the sheet conveyance path stays within a detection range of the first detection sensor, and acquires the reaching time by measuring a time required for the remaining sheet to be detected by the second detection sensor after detected by the first detection sensor.

6. The image forming apparatus according to claim 5, wherein the processor determines whether the remaining sheet is being properly conveyed, in accordance with a speed of conveyance of the remaining sheet being conveyed in the sheet conveyance path, the length of the remaining sheet in a direction of conveyance of the remaining sheet, and the staying time and the reaching time.

7. The image forming apparatus according to claim 4, wherein when the staying time is not longer than a predetermined staying time, the processor determines that the remaining sheet is being properly conveyed.

8. The image forming apparatus according to claim 4, wherein when the reaching time is not longer than a predetermined reaching time, the processor determines that the remaining sheet is being properly conveyed.

9. The image forming apparatus according to claim 8, wherein the predetermined staying time is set in accordance with a time required for two remaining sheets to successively pass through the first position, the two remaining sheets having the greatest length in the sheet conveying direction among the remaining sheets.

10. The image forming apparatus according to claim 8, wherein the predetermined staying time is set in accordance with a time required for two sheets to successively pass through the first position, the two sheets having the greatest length in the sheet conveying direction among sheets conveyable in the sheet conveyance path.

11. The image forming apparatus according to claim 1, wherein when each of the detected sheets is monitored for a conveyance error in the sheet conveyance path during the second sheet conveyance, and the conveyance error monitoring is completed on all the remaining sheets, the processor determines that all the remaining sheets have been discharged.

12. The image forming apparatus according to claim 1, wherein the processor sets priorities for each of a plurality of conveyance sections defined in the sheet conveyance path during the second sheet conveyance, and, in accordance with the priority order, controls the sheet conveyance unit to discharge the detected sheets to outside.

13. The image forming apparatus according to claim 1, wherein the processor sets discharge paths for each of a plurality of conveyance sections defined in the sheet conveyance path during the second sheet conveyance, and controls the sheet conveyance unit to discharge the detected sheets to outside through the discharge paths.

14. A non-transitory recording medium storing a computer readable control program for causing an image forming apparatus to execute:

starting a printing process, and conveying a sheet along a sheet conveyance path in the image forming apparatus in one of a first sheet conveyance and a second sheet conveyance, wherein the first sheet conveyance conveys the sheet along the sheet conveyance path in accordance with sheet information included in the print job, and the second sheet conveyance discharges the sheet to outside the image forming apparatus in accordance with a result of detection performed by a sheet detector installed in the sheet conveyance path, regardless of the sheet information;

suspending the printing process and suspending sheet conveyance in the sheet conveyance path;

when sheet conveyance in the sheet conveyance path is resumed after a suspension, and the sheet detector detects a sheet in a section of the sheet conveyance path, conveying the sheet in accordance with a result of detection performed by the sheet detector, regardless of the sheet information, in the second sheet conveyance, and discharging the sheet to outside, the sheet not hindering the sheet conveyance; and when sheet conveyance in the sheet conveyance path is resumed after the suspension, and the sheet detector does not detect the sheet in the section of the conveyance path, control the sheet conveyance unit to activate the sheet conveyance unit in the section and then determine if the sheet is detected by the sheet detector, and if the sheet is detected after activation of the sheet conveyance unit, conveying the detected sheet in the second sheet conveyance in the sheet conveyance path and does not hinder the sheet conveyance resumed after suspension.

15. An image forming method comprising:

conveying a sheet along a sheet conveyance path;

detecting the sheet in the sheet conveyance path;

acquiring a print job related to the sheet;

forming an image on the sheet;

performing first sheet conveyance wherein the sheet is conveyed in accordance with sheet information included in the print job, when sheet conveyance in the sheet conveyance path is resumed after a suspension, and the sheet detector detects a sheet in a section of the sheet conveyance path, conveying the sheet in accordance with a result of detection performed by the sheet detector, regardless of the sheet information, in the second sheet conveyance, and discharging the sheet to outside, the sheet not hindering the sheet conveyance; and when sheet conveyance in the sheet conveyance path is resumed after the suspension, and the sheet detector does not detect the sheet in the section of the conveyance path, control the sheet conveyance unit to activate the sheet conveyance unit in the section and then determine if the sheet is detected by the sheet detector, and if the sheet is detected after activation of the sheet conveyance unit, conveying the detected sheet in the second sheet conveyance in the sheet conveyance path and does not hinder the sheet conveyance resumed after suspension.

* * * * *